US005636926A

United States Patent [19]

Yamaguchi

[11] Patent Number: 5,636,926

[45] Date of Patent: Jun. 10, 1997

[54] TAPE-SHAPED LABEL PRODUCING DEVICE

[75] Inventor: Koshiro Yamaguchi, Kasugai, Japan

[73] Assignee: Brother Kogyo Kabushiki Kaisha, Nagoya, Japan

[21] Appl. No.: 499,685

[22] Filed: Jul. 7, 1995

Related U.S. Application Data

[63] Continuation-in-part of Ser. No. 298,676, Aug. 31, 1994, Pat. No. 5,536,092.

[30] Foreign Application Priority Data

Sep. 6, 1993 [JP] Japan ..... 5-221426
Jul. 15, 1994 [JP] Japan ..... 6-0186478

[51] Int. Cl.[6] ..... B41J 2/305

[52] U.S. Cl. ..... 400/120.02; 400/586; 400/615.2; 347/178

[58] Field of Search ..... 400/120.02, 613, 400/580, DIG. 2; 347/172, 177, 178

[56] References Cited

U.S. PATENT DOCUMENTS 5,399,030 3/1995 Niwa et al. ..... 400/586
5,447,382 9/1995 Yui et al. ..... 400/120.02
5,480,237 1/1996 Tanahashi ..... 400/120.02
5,496,118 3/1996 Ueno et al. ..... 400/586

FOREIGN PATENT DOCUMENTS 1-85050 6/1989 Japan .
5-84994 4/1993 Japan .

*Primary Examiner*—John S. Hilten
*Attorney, Agent, or Firm*—Oliff & Berridge

[57] ABSTRACT

Either when the tape cassette is loaded in the tape-shaped label producing device or directly after power is turned on, the tape and the ink ribbon are fed in synchronization in a printing direction. At this time, with using the distinction marks, the ink color of the ink ribbon is detected at a standard position that is a predetermined distance upstream from the print head. From this, it is possible to determine the ink color at a printing position, based on the ink color that has been detected either when the tape cassette is loaded in the tape-shaped label producing device or directly after power is turned on, and a post-detection ink ribbon feed amount.

27 Claims, 18 Drawing Sheets

TB

| | | FIRST DETEC-TION SWITCH | SECOND DETEC-TION SWITCH | THIRD DETEC-TION SWITCH | FOURTH DETEC-TION SWITCH | FIFTH DETEC-TION SWITCH | SIXTH DETEC-TION SWITCH |
|---|---|---|---|---|---|---|---|
| INK COLOR | MONO-COLOR | ON | ON | / | / | / | / |
| | BLACK/RED | ON | OFF | / | / | / | / |
| TAPE WIDTH | 12mm | / | / | OFF | OFF | / | / |
| | 18mm | / | / | OFF | ON | / | / |
| | 24mm | / | / | ON | OFF | / | / |
| | 32mm | / | / | ON | ON | / | / |
| TAPE TYPE | RECEPTOR | / | / | / | / | ON | ON |
| | LAMINATE | / | / | / | / | ON | OFF |
| | NO CASSETTE | / | / | / | / | OFF | OFF |

TAPE-SHAPED LABEL PRODUCING DEVICE

This is a continuation-in-part of application Ser. No. 08/298,676, filed Aug. 31, 1994, now U.S. Pat. No. 5,536, 092.

BACKGROUND OF THE INVENTION

1. Field of the Invention

The present invention relates to a tape-shaped label producing device and more particularly to a tape-shaped label producing device capable of printing inputted characters and symbols in color on a tape and cutting the printed tape into a tape-shaped label.

2. Description of the Related Art

Japanese Utility Model Application Publication Kokai No. HEI-1-85050 describes a tape printer for printing characters, symbols, and marks on a tape, which serves as the medium for printing. The printed tapes are well-suited for uses as labels adhered to the binding of files. The tape printer includes a keyboard, a display, and a thermal print type printing mechanism for monochromatically printing, such as in black, red, or green, characters and symbols on a tape with a width of, for example, 6, 9, 12, 18, or 24 mm at various character sizes and fonts.

SUMMARY OF THE INVENTION

It is conceivable that this tape printer is improved to be capable of printing characters and symbols inputted from the keyboard in two colors such as black and red, black and green, or red and green mixed together. The ink ribbon that allows such printing is coated alternately with the two colors of ink, each color being provided at a predetermined length of, for example, about 20 cm. Further, barcode-shaped distinction marks for demarcating ink color are marked at the starting edge of each same-colored ink region. A control device of the tape-shaped label producing device includes an ink-color detection sensor for detecting the distinction marks. While printing control processes are being executed, the control device constantly detects a color distinction signal outputted from the ink-color detection sensor that detects the distinction mark and controls the tape-shaped label producing device so that the ink of the color, designated by printing color indication data stored in the print data, is fed into confrontation with the printing position at the thermal head.

In order to print in two colors with an ink ribbon alternately coated with two colors of ink, the control device must execute feed control of the print tape and the ink ribbon and drives the thermal head. In addition, in order to print character strings designated in designated ink colors, the control device must execute ink-color detection control by constantly detecting a color distinction signal from the ink-color detection sensor. This places an extremely large burden on the central processing unit (CPU) provided to the control device, which slows down printing processes.

Japanese Patent Application Publication Kokai No. 5-84994 describes another tape printer. A cutting mechanism provided to the tape printer of this document cuts a label out of the printed tape so that front and rear margins are provided in front of and in the rear end of the printed character string. When cutting the tape with a margin amount provided in front of the printed string of characters, printing is executed while the tape feed motor is driven at a slow speed. When the cutting position provided with this front margin arrives at the cutter of the tape cutting mechanism, tape feed and printing by the thermal head are temporarily stopped and the front edge position provided with the front margin amount is cut. Printing operations are then continued by restarting control of printing with the thermal head and control of slow-speed feed by the tape feed motor. The slow-speed operations ensure that when the front edge position is cut, printed characters are not divided so that quality of characters printed on the tape-shaped label does not suffer.

However, this slow-speed feed operation slows down the entire printing processes. Additionally, when enhanced characters made from lines, especially outline characters, are printed, the slow-speed feed operation will possibly divide the characters.

It is therefore an objective of the present invention to solve the above problems and to provide a tape-shaped label producing device wherein printing can be accurately, quickly, and easily performed in a designated ink color without detecting the color of the ink ribbon during printing processes.

It is another objective of the present invention to provide a tape-shaped label producing device capable of producing tape shaped labels by cutting the tape without adversely effecting quality of printed characters and without reducing the performance of printing processes.

In order to achieve the above objectives and other objectives, the present invention provides a tape-shaped label producing device comprising: mounting means for mounting a tape cassette which houses an ink ribbon and a tape serving as a print medium, the ink ribbon being formed by coating, cyclically in a predetermined order, regions of a predetermined length with different colors of a plurality of colored inks and by marking ink-distinction marks at a starting edge of each region coated with a same color ink; printing means including a print head for printing on the tape via the ink ribbon at a printing position; tape feeding means for feeding the tape in a printing direction; ribbon feeding means for feeding the ink ribbon in the printing direction in synchronization with the tape; printing control means for controlling the printing means, the tape feeding means, and the ribbon feeding means; ink color detection means provided at a standard position, the ink color detection means detecting ink colors of the ink ribbon based on the color-distinction marks; and ink-color determining means determining ink color at the printing position, based on an ink color detected by the ink color detection means and a post-detection ink ribbon feed amount, with which the ink ribbon is fed by the ribbon feed means after the ink color is detected.

The ink color detection means preferably detects ink colors of the ink ribbon using the color-distinction marks, before the print head starts printing on the tape. The ink color detection means may detect ink colors of the ink ribbon using the color-distinction marks, when the tape cassette is loaded in the mounting means or directly after power is turned on.

According to another aspect, the present invention provides a tape-shaped label producing device comprising: a print head for printing on a tape, which serves as a print medium, at a printing position; a platen roller capable of pressing the tape against the print head; movement means for switching at least one of the print head and the platen roller between a pressing position wherein the tape is pressed against the print head and a release position wherein the tape is not pressed against the print head; tape feeding means capable of selectively feeding the tape in a printing direction and a reverse printing direction; tape cutting means provided at a position downstream from a printing position and for cutting the tape; a printing control means for controlling the print head, the tape feed means and the tape cutting means; and cutting control means for receiving printing information from the printing control means and for cutting the tape using the tape cutting means after when each block is completely printed on the print tape, the movement means switches the print head and the platen roller into the release position, and the tape feed means reversely feeds the tape, in a reverse printing direction, a predetermined distance determined from the print data and an edge margin length.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
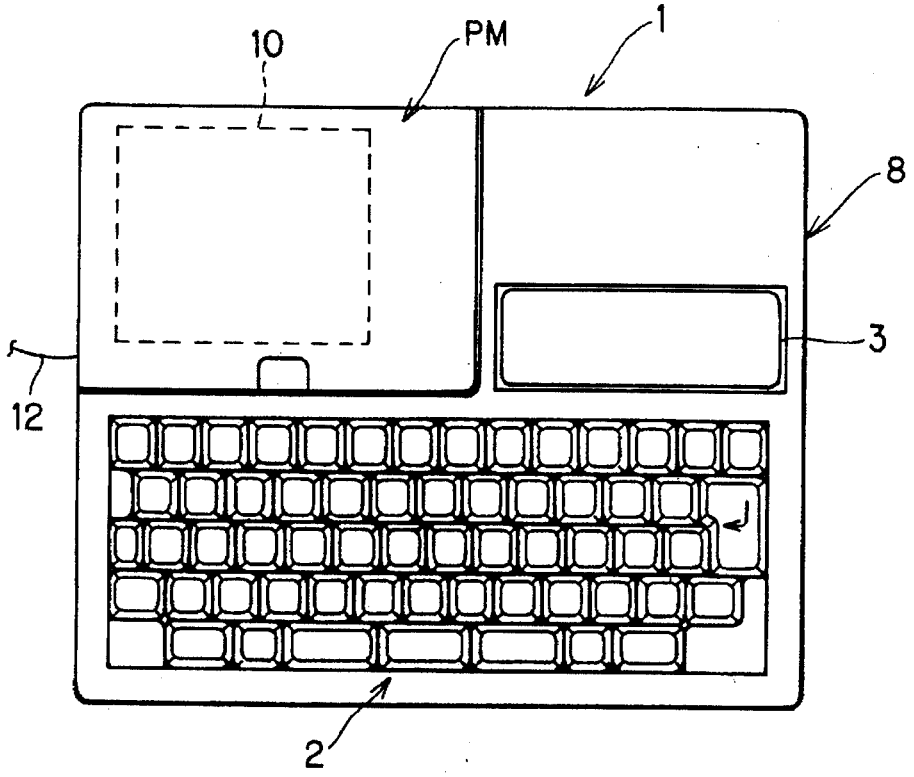
FIG. 1 is a planar view showing a tape printer according to a preferred embodiment of the present invention.

A tape-shaped label producing device according to a preferred embodiment of the present invention will be described while referring to accompanying drawings wherein same or like components are designated by the same reference numerals to avoid duplicating description.

The present embodiment is related to a tape printer capable of printing a plurality of characters, such as symbols and alphanumeric characters, in two different colors, on print tapes which serve as a print medium.

As shown in FIG. 1, a keyboard 2 provided with a variety of function keys, such as a power switch and a label production key, in addition to character keys, such as for symbols and alphanumeric characters, is provided to the front portion of the frame 8 of the tape printer 1. A liquid crystal display 3 capable of displaying inputted characters and symbols is provided directly to the rear of the keyboard 2. Also, a thermal printing mechanism PM having a thermal head 36 is provided at the rear of the display 3 internally to the frame 8.

Figure 2:
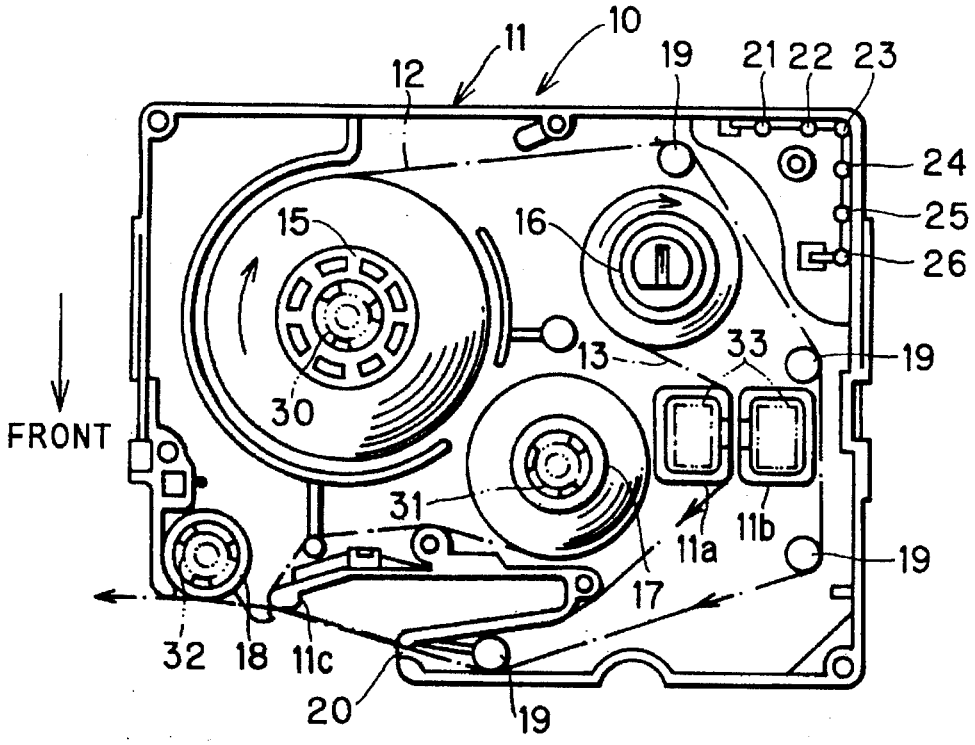
FIG. 2 is a planar view of a receptor-type tape cassette used in the tape-shaped label producing device of the embodiment.
Figure 3:
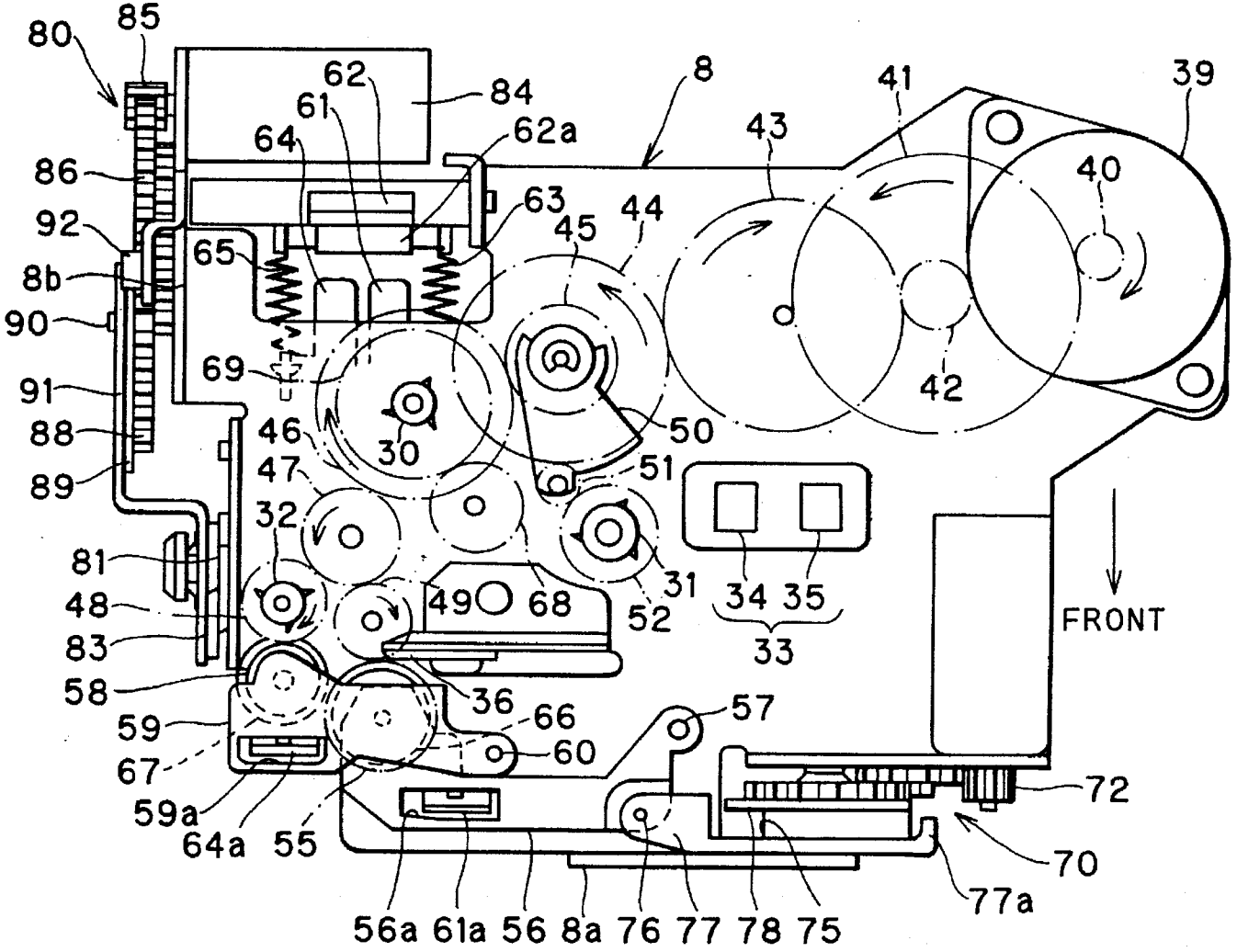
FIG. 3 is a planer view showing a thermal print mechanism PM when a platen roller thereof is in a pressing position.
Figure 4:
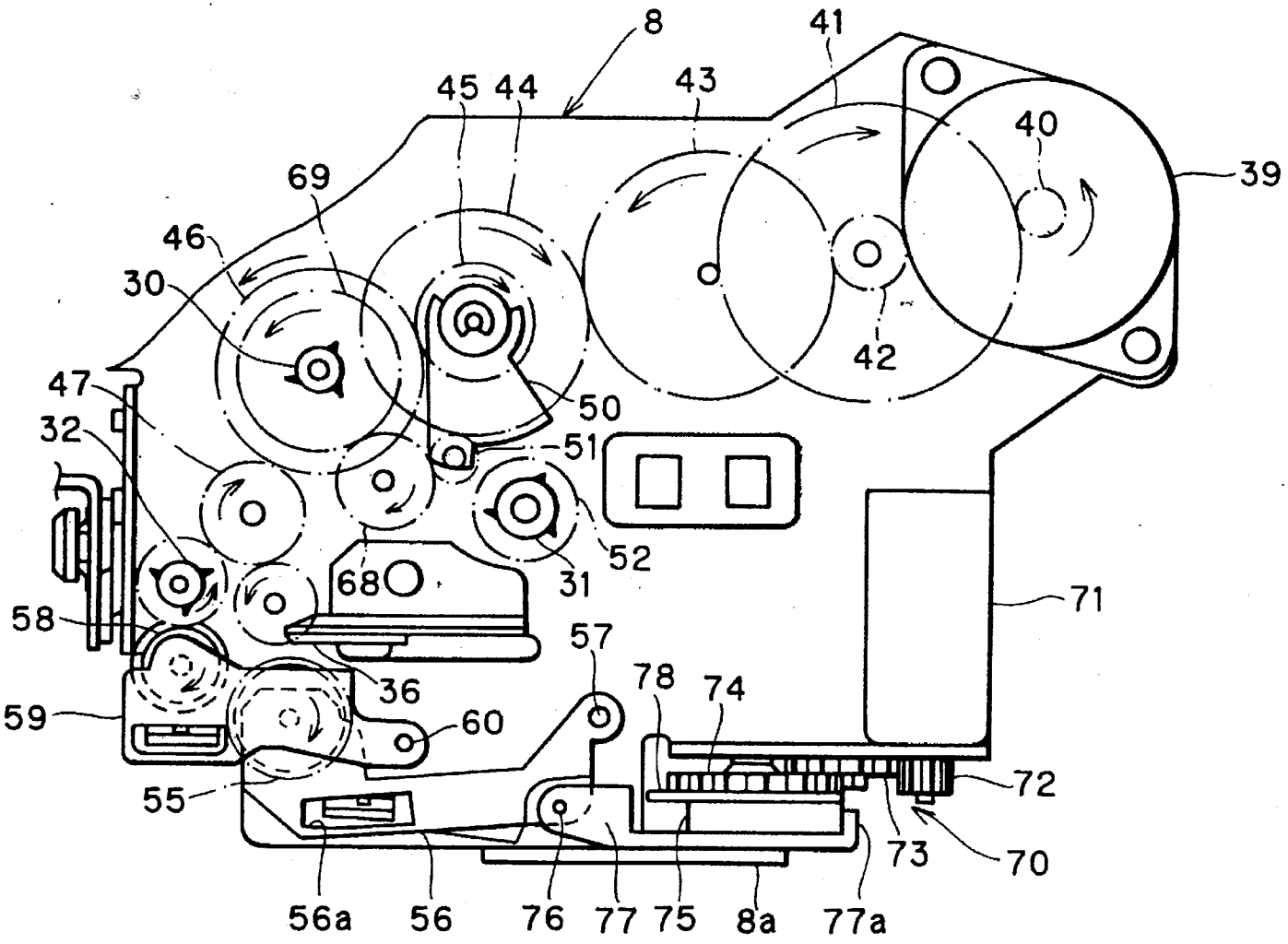
FIG. 4 is a planer view showing the thermal print mechanism when the platen roller is in a release position.

Next, an explanation of the thermal printing mechanism PM will be provided while referring to FIGS. 2 through 4.

First, an explanation will be provided for a tape cassette 10 based on FIG. 2. The tape cassette 10 is for two-color printing and is detachably mountable to the thermal printing mechanism PM.

Internally to the cassette case 11 of the tape cassette 10 are disposed a tape spool 15 around which is wound a receptor-type print tape 12; a ribbon spool 16 around which is wound a two-colored ink ribbon 13; a ribbon retrieval spool 17 for winding up the ink ribbon 13; and a tape feed roller 18 for supplying the print tape 12. The tape spool 15, the ribbon spool 16, the ribbon retrieval spool 17, and the tape feed roller 18 are provided so as to be freely rotatable.

The print tape 12 is drawn from the tape spool 15 by the tape feed roller 18, and is guided around four guide rollers 19, through an opening 20, past the thermal head 36, and out of the tape cassette 10. On the other hand, the ink ribbon 13 is drawn from the ribbon spool 16 and is guided around a left guide wall 11*a* (of the pair of guide walls 11*a* and 11*b* formed to the cassette case 11) to the opening 20. After passing through the opening 20, the ink ribbon 13 is drawn temporarily parallel with the print tape 12 past the thermal head 36. The ink ribbon 13 is then guided by the partition wall 11*c* to be wound up by the ribbon retrieval spool 17.

It should be noted that a variety of receptor-type print tapes 12, for example, having different tape widths, and a variety of different color ink ribbon 13 are available for use in the tape cassette 10. Another variety of laminate-type print tapes 12, having different tape widths, for example, can be mounted in the tape cassette 10, in place of the receptor-type tapes 12. For detecting which of the variety of print tapes 12 and ink ribbons 13 are in the tape cassette 10, a detection hole group formed by the presence or absence of any of six detection holes 21 through 26 is provided to the base of the cassette case 11.

Next, an explanation of the feed drive mechanism capable of moving the print tape 12 and the ink ribbon 13 in a printing direction, and also capable of reversely feeding the print tape 12 in a reverse printing direction, will be provided while referring to FIGS. 3 through 4.

A tape reverse drive cam 30 for engaging the tape spool 15, a ribbon drive cam 31 for engaging the ribbon retrieval spool 17, and a tape drive cam 32 for engaging the tape feed roller 18 are disposed to the frame 8 so as to be rotatable about their respective axes. A detection sensor 33 is provided to the frame 8. The detection sensor 33 is of a photointerrupter type, and includes a light-generating element 34 to be received in the guide wall 11*a* and a light-receiving element 35 to be received in the guide wall 11*b*. The thermal head 36 and a cassette switch 37 (not shown) are also disposed to the frame 8. The cassette switch 37 includes six switches (a first through sixth switches) for detecting the presence or absence of the six detection holes 21 through 26.

As shown in FIGS. 2 and 3, the detection sensor 33 is positioned in the supply path of the ink ribbon 13 at a standard position that is upstream from the thermal head 36 and that is separated from the thermal head 36 by a predetermined distance (for example, about 6.5 cm). While the ink ribbon 13 passes this standard position, the detection sensor 33 detects distinction marks M1 and M2 (to be described later) that are marked on the ink ribbon 13.

A tape drive motor 39, made from a stepping motor, is attached to the right-rear corner of the frame 8. A train of gears 41 through 47 are rotatably supported to the frame 8 and are engaged in series starting with a drive gear 40 of the tape drive motor 39. A gear 48 fixed to the tape drive cam 32 is engaged with the gear 47. This train of gears 40 through 48 transmits rotation of the tape drive motor 39 to the tape drive cam 32.

A base tip of a swinging arm 50 is connected to the gear 45 via a slip mechanism. An orbit gear 51 is supported at a tip end of the swinging arm 50 so as to be rotatable about the axis of the orbit gear 51 and in constant engagement with the gear 45. When the gear 45 rotates in the direction for normal printing (i.e., counterclockwise in FIG. 3), the swinging arm 50 also rotates in the counterclockwise direction so that the orbit gear 51 engages with a ribbon-drive gear 52 that is connected to the ribbon drive cam 31 via a clutch spring (not shown). Rotation of the ribbon-drive gear 52 drives the ribbon retrieval spool 17 to rotate and wind up the ink ribbon 13 onto the ribbon retrieval spool 17.

Axial shafts 57 and 60 are disposed to the frame 8. A platen holder 56 is supported on the axial shaft 57 so as to be pivotable on the axial shaft 57. A rubber platen roller 55 is supported on the platen holder 56. A pressure roller holder 59 is supported on the axial shaft 60 so at to pivotable on the axial shaft 60. A rubber pressure roller 58 is supported on the pressure roller holder 59.

An opening 56*a* is formed to the platen holder 56. A platen-drive lever 61 is disposed to the base of the frame 8 aligned from front to rear of the frame 8, that is, from the bottom to the top of FIG. 3. An upright portion 61*a* at the front tip of the platen-drive lever 61 is engaged in the opening 56*a*. An association lever 62, which moves in association with a cover frame 9 (see FIG. 7), is connected at its lower tip attachment portion 62*a* with the rear tip of the platen-drive lever 61 via a pulling spring 63. Pulling force of the pulling spring 63, as transmitted by the platen-drive lever 61 and the platen holder 56, constantly presses the platen roller 55 against the thermal head 36.

Similarly, an opening 59*a* is formed in the pressure roller holder 59. A pressure roller drive lever 64 is disposed to the base of the frame 8 aligned from front to rear of the frame 8. An upright portion 64*a* at the front tip of the pressure roller drive lever 64 is engaged in the opening 59*a*. The association lever 62 is connected at its lower tip attachment portion 62*a* with the rear tip of the pressure roller drive lever 64 via a pulling spring 65. The pressure roller 58 is constantly pressed against the tape feed roller 18 by the spring force of the pulling spring 65 via the pressure roller drive lever 64 and the pressure roller holder 59.

When the platen roller 55 is in the pressing position shown in FIG. 3 for pressing the ink ribbon 13 and the print tape 12 together against the print head 36, a platen gear 66, which is fixed to the lower tip of the platen roller 55, is put in engagement with an intermediate gear 49, which is engaged with the gear 47. When the pressure roller 58 is in the pressing position shown in FIG. 3 for being pressed against the tape feed roller 18, a pressure roller gear 67 fixed to the lower tip of the pressure roller 58 is engaged with the gear 48.

Figure 8:
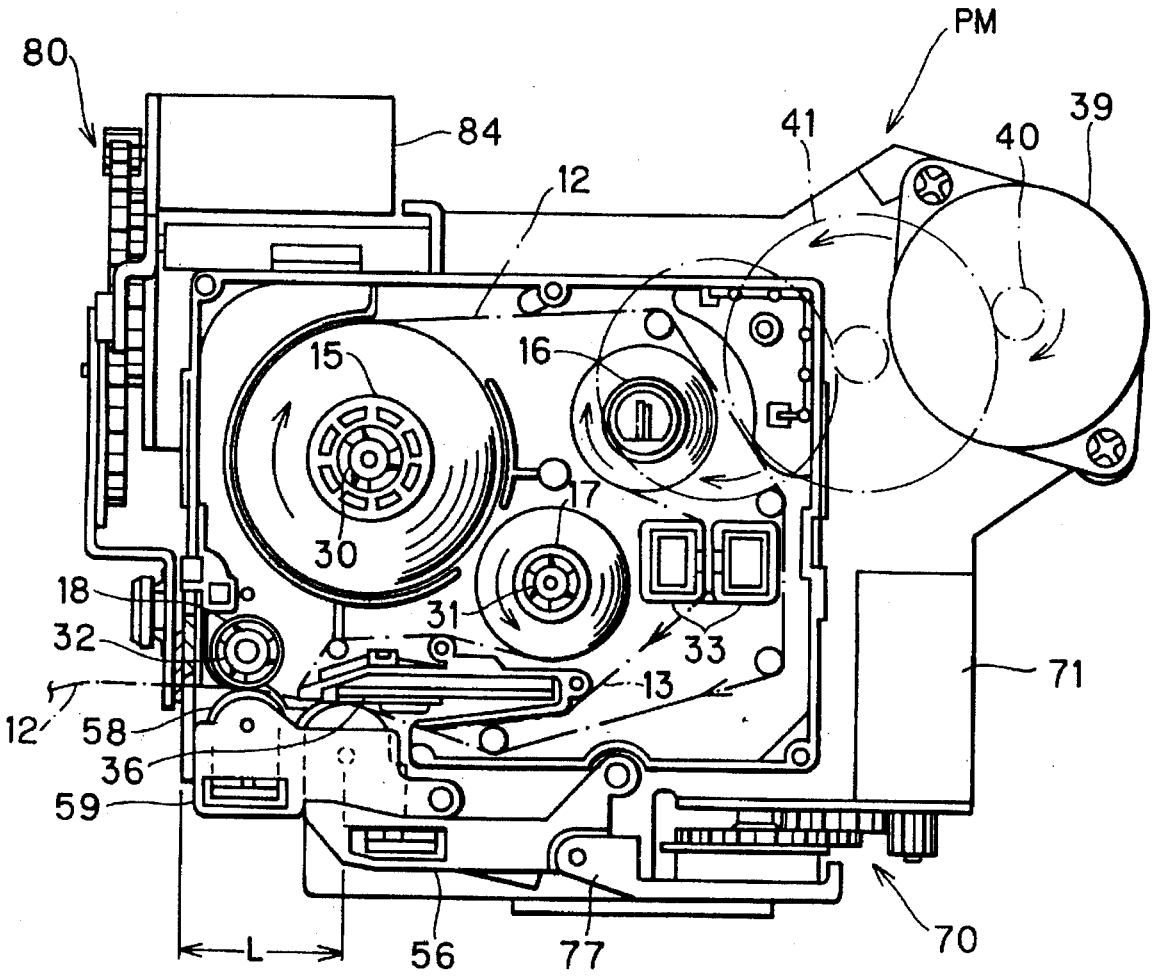
FIG. 8 is a planar view showing the thermal print mechanism when the platen roller is in the pressing position of FIG. 3 and a print tape is being fed therein.

When the tape drive motor 39 is driven to rotate in the direction for normal printing (i.e., clockwise in FIG. 3), the gears 40 through 49 are driven to rotate in the directions indicated by arrows in FIGS. 3 and 8 so that the pressure roller 58 and the platen roller 55 are rotated in the counterclockwise direction in synchronization. This feeds the print tape 12 serially past the thermal head 36. Simultaneously with this, the ribbon drive cam 31 is rotated by the rotation of the ribbon-drive gear 52 so that the ribbon retrieval spool 17 rotates and winds up the ink ribbon 13.

Figure 9:
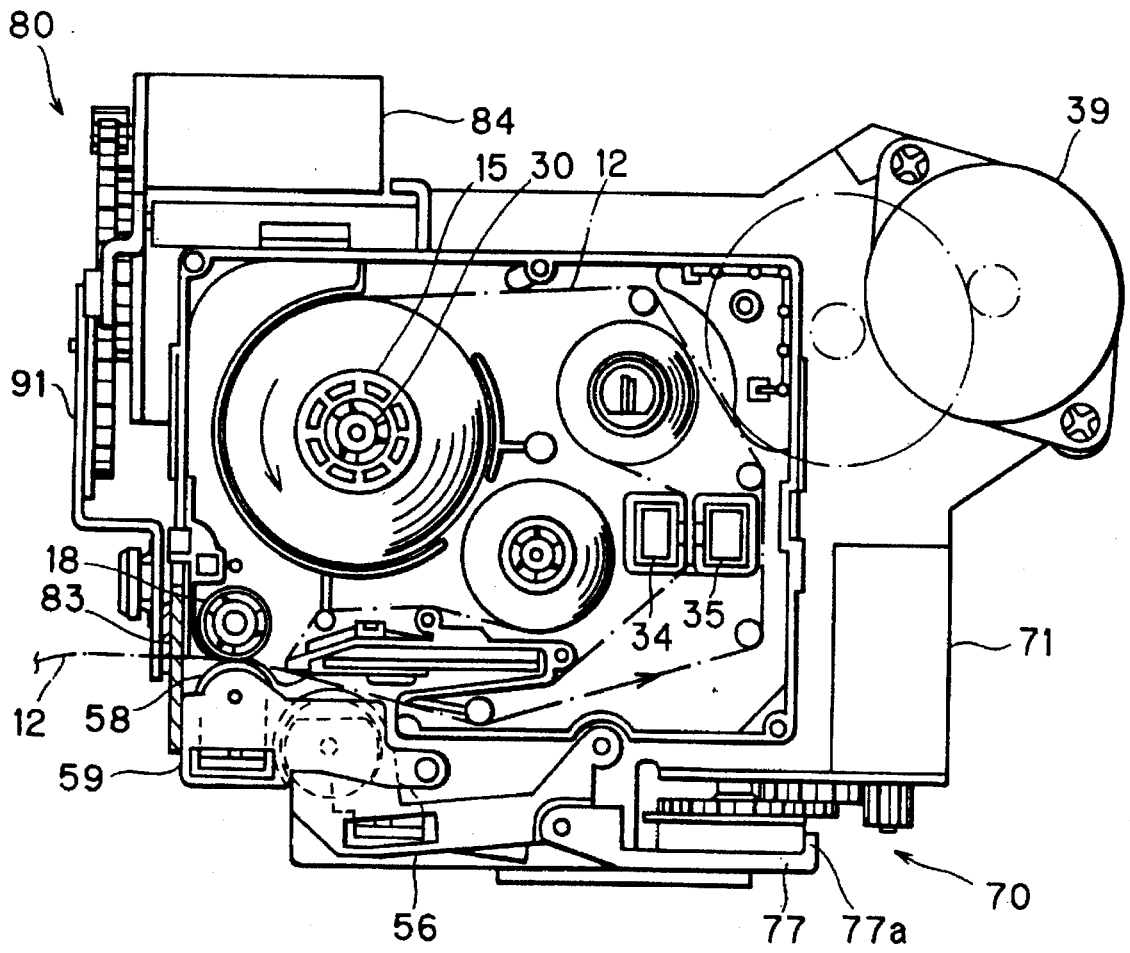
FIG. 9 is a planar view showing the thermal print mechanism when the platen roller is in the release position of FIG. 4 and the print tape is being reversely fed.

As shown in FIGS. 4 and 9, when the tape drive motor 39 is rotated in the direction opposite for normal printing (i.e., the counterclockwise direction in FIGS. 4 and 9), the gears 40 through 49 are driven to rotate in a direction opposite that for normal printing. Rotation of the gears 40 through 49 in the directions shown causes the pressure roller 58 and the platen roller 55 to rotate in the clockwise direction and the gear 45 to rotate in the clockwise direction. The swinging arm 50 in association with the gear 45 also pivots in the clockwise direction so that the orbit gear 51 is brought into engagement with the intermediate gear 68. Counterclockwise rotation of the orbit gear 50 rotates the intermediate gear 68 clockwise, which rotates the reverse gear 69 counterclockwise. A tape reverse drive cam 30 attached to the axial shaft of the reverse gear 69 is reversely rotated in association with counterclockwise rotation of the reverse gear 69 via a clutch spring, not shown in the drawings. In this way, the print tape 12 only is reversely fed, without the ink ribbon 13 being reversely wound up while the print tape 12 is winding onto the tape spool 15. Associated movement of the pressure roller 58 and the tape feed roller 18 reversely winds the print tape 12 by a lesser amount than the amount the print tape 12 is taken up by the tape spool 15. This prevents the print tape 12 from crumpling up during reverse feed.

Figure 5:
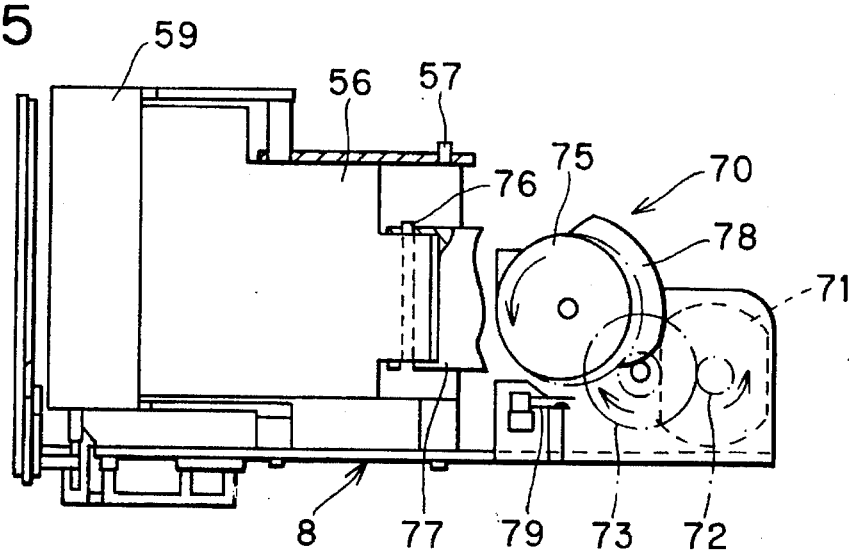
FIG. 5 is a schematic front view with a portion removed to show a part of the thermal print mechanism.
Figure 6:
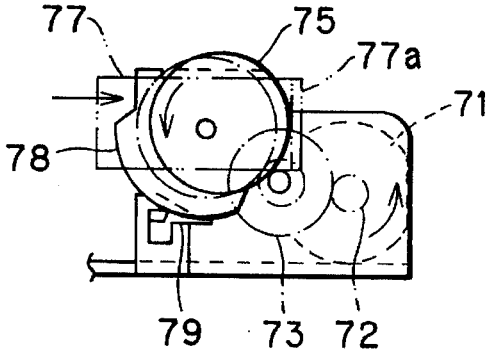
FIG. 6 is a schematic front view showing an essential portion of FIG. 5.

Next, an explanation of the platen drive mechanism 70 for moving the platen roller 55 into a release position, wherein the platen roller 55 is separated from the thermal head 36, will be provided while referring to FIGS. 4 through 6.

A platen moving motor 71, made from a DC motor, is fixed to the front-right corner of the frame 8. A drive gear 72 is attached to the drive shaft of the platen moving motor 71. An intermediate gear 73 is engaged with the drive gear 72. Further, a cam drive gear 74 for engaging the intermediate gear 73 is rotatably supported on the frame 8. An eccentric cam 75 is integrally fixed to the cam drive gear 74.

The left tip of a platen association lever 77 is pivotally supported on a vertically-extending support shaft 76 fixed to the right tip of the platen holder 56. The platen association lever 77 is disposed between the eccentric cam 75 and an upwardly bent protruding wall 8*a* at the front tip of the frame 8 so as to be horizontally movable, that is, movable to the left and right FIG. 4. Further, a bent abutment portion 77*a* at the right tip of the platen association lever 77 protrudes rearward in confrontation with the right cam surface of the eccentric cam 75.

When the platen moving motor 71 is driven to rotate in the counterclockwise direction as viewed in FIG. 5, the eccentric cam 75 is rotated in the counterclockwise direction via the cam drive gear 74 and the intermediate gear 73. The abutment portion 77*a* of the platen association lever 77 slides along the cam surface of the eccentric cam 75 so that the platen association lever 77 is moved horizontally by the eccentric movement of the eccentric cam 75. When the platen association lever 77 moves maximally to the right, as shown in FIGS. 4 and 9, the platen holder 56 pivots in the counterclockwise direction with the axial shaft 57 as the pivotal center. The platen roller 55 supported on the platen holder 56 moves away from the thermal head 36 into the release position.

A thin-plate-shaped switch drive cam 78 is fixed between the eccentric cam 75 and the cam drive gear 74. The switch drive cam 78 is driven to rotate integrally with the eccentric cam 75. Further, a phase detection switch 79 is provided below the switch drive cam 78 at a position where the switch 79 will be closed when pressed by a protruding cam portion of the switch drive cam 78. The phase detection switch 79 is opened, that is, in an off condition, when the platen association lever 77 is moved maximally leftward and the platen roller 55 is in the pressing position shown in FIG. 3 for pressing the tape 12 and the ribbon 13 against the head 36. Afterward, when the platen moving motor 71 is driven to rotate in the counterclockwise direction, the platen association lever 77 will be moved maximally rightward, the platen roller 55 will be in the release position as shown in FIG. 4, and the phase detection switch 79 is closed, that is, in an ON condition, as shown in FIG. 6.

Figure 7:
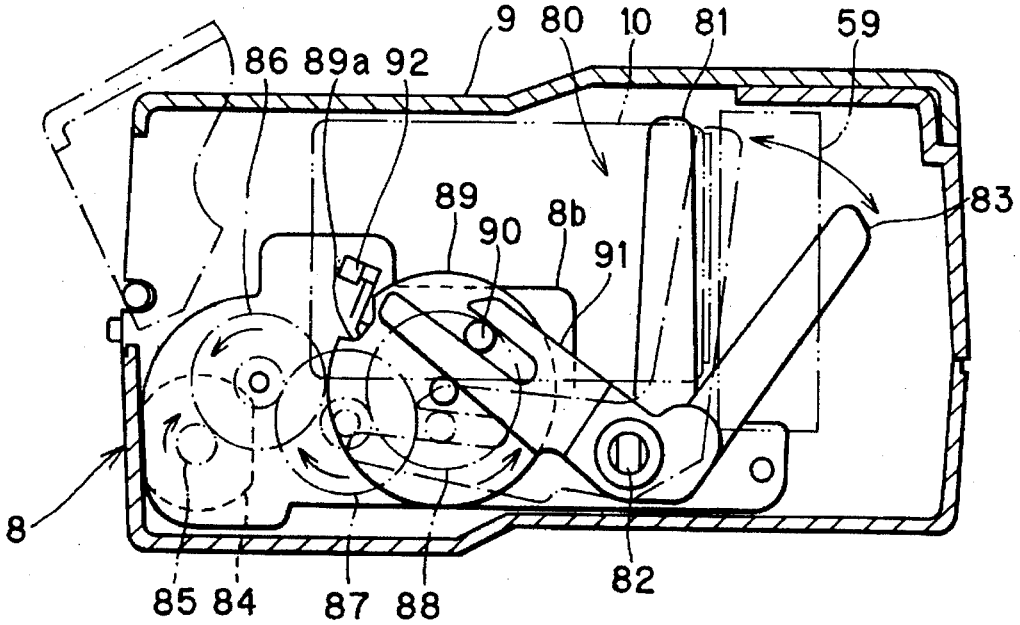
FIG. 7 is a side view showing a cutting mechanism of the thermal print mechanism.

Next, an explanation of a tape cutting mechanism 80 for cutting the print tape 12 printed on and discharged from the tape cassette 10 by the associated movement of the pressure roller 58 and the tape feed roller 18 will be provided while referring to FIGS. 3 and 7.

A fixed blade 81 is fixed to the left upright wall 8*b* of the frame 8. A mobile or movable blade 83 is pivotally supported to the support shaft 82 attached to the left upright wall 8*b* near the fixed blade 81.

On the other hand, a cutting motor 84 made from a stepping motor is fixed to the rear-left tip of the frame 8. A driven gear 88 is engaged with the drive gear 85 of the cutting motor 84 via the two engaged intermediate gears 86 and 87. A rotation plate 89 is attached to the driven gear 88. An engagement pin 90 attached to the rotation plate 89 is freely slidably engaged between the two prongs of a swinging arm 91 that extends from the base of the mobile blade 83. When the cutting motor 84 is driven to rotate in a predetermined direction shown in FIG. 7 and the rotation plate 89 is rotated once via the gears 85 through 88, the reciprocal swinging movement of the two prongs of the swinging arm 91 swings the mobile blade 83 from an open condition, that is a predetermined angle to the fixed blade 81 as indicated by the solid line in FIG. 7, to a cutting condition indicated by the two-dot chain line, and then again to the open condition.

It should be noted that a single notch 89*a* is formed in the rotation plate 89 and a detection switch 92 is provided adjacent to the rotation plate 89. When the mobile blade 83 is in the open condition after a single reciprocal swing of the mobile blade 83 in a cutting operation, the notch 89*a* turns the detection switch 92 off so that power for driving the cutting motor 84 is turned off.

Figure 10:
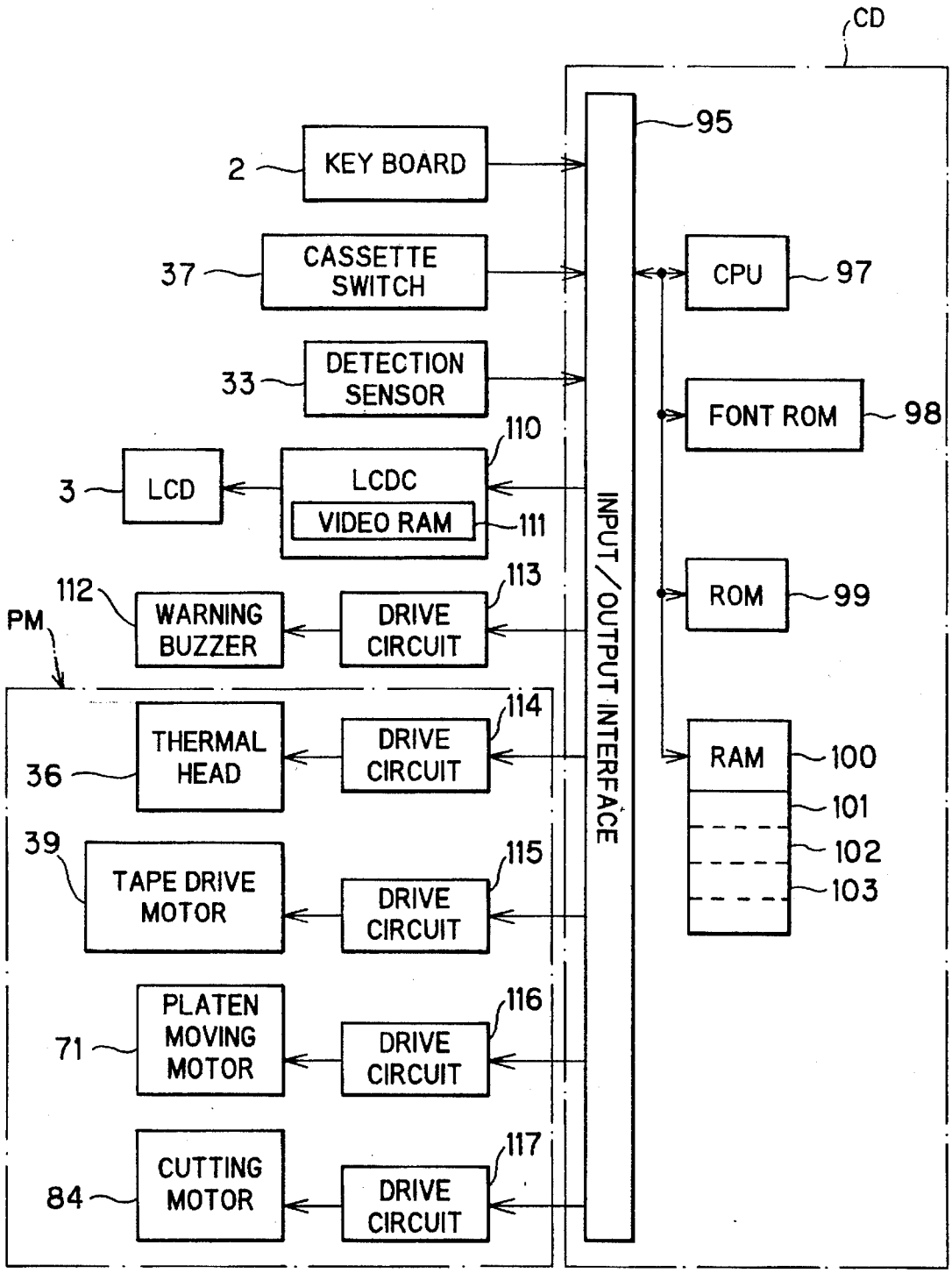
FIG. 10 is a block diagram showing a control system of the tape printer.

The control system of the tape printer 1 is configured as shown in the block diagram shown in FIG. 10.

To an input/output interface 95 of the control device CD is connected the keyboard 2; the cassette switch 37; the detection sensor 33; a display controller (LCDC) 110 having a video RAM 111 for outputting display data to the liquid crystal display 3; a drive circuit 113 for a warning buzzer 112; a drive circuit 114 for driving the thermal head 36; a drive circuit 115 for driving the tape drive motor 39; a drive circuit 116 for the platen moving motor 71; and a drive circuit 117 for the cutting motor 84.

The control device CD includes a CPU 97; the input/output interface 95 connected to the CPU 97 via a bus 96 such as a data bus; a font RAM 98; a ROM 99; and a RAM 100.

The font RAM 98 stores display dot pattern data for each of a plurality of characters such as alphabetic characters and symbols. The print dot pattern data is stored categorized in a plurality of print character sizes.

The ROM 99 stores a variety of control programs including a display drive control program for controlling the display controller 110 according to code data of characters such as characters, symbols, and numbers, inputted through the keyboard 2; a print drive control program for serially outputting dot pattern data for each row of dots to the thermal head 36 and the tape drive motor 39 so as to control the components 36 and 39 to perform printing operation; and a print position initialization control program and a label production control program (to be described later) which are control programs particular to the present invention.

Figures 11, 12:
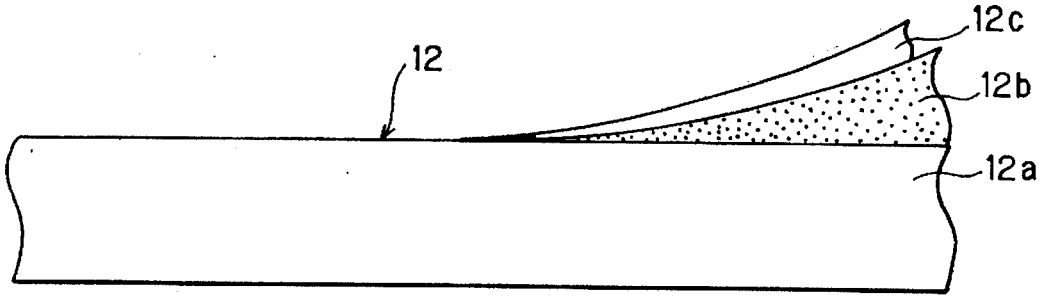
FIG. 11 is a table for explaining setting contents of a cassette-type determination table TB.
FIG. 12 is a perspective view of a receptor-type print tape divided into its component parts.

The ROM 99 also stores a cassette type determination table TB as shown in FIG. 11. The cassette type determination table TB is for determining the ink color, tape width, and tape type based on ON and OFF combinations of the first through sixth detection switches of the cassette switch 37. The table TB is also used for determining whether a tape cassette 10 is actually mounted in the frame 8.

As shown in FIG. 12, the receptor-type print tape 12 is formed by coating an adhesive layer 12*b* to the rear surface of a printable film tape 12*a* and adhering a peel-away sheet 12*c* to the adhesive layer 12*b*. Printing is performed on the front surface of the film tape 12*a*. Although not shown in the drawings, a laminate-type print tape 12 is formed from a transparent printable laminate film. Printing is performed on the rear surface of the laminate film. After printing, an adhesive tape adhered with a peel-away sheet is adhered to the rear surface of the laminate film.

The RAM 100 includes a text memory 101 for storing, as text data, code data inputted from the keyboard 2; a print buffer 102 for developing and storing dot pattern data in correspondence with character codes stored in the text memory 101; and a flag memory 103 for storing flag data of a color flag CF indicating which color of the two colors (black and red) of the ink ribbon 13 is in confrontation with the thermal head 36. The color flag CF is set to one when a black ink 13*b* region of the ink ribbon 13 is in confrontation with the thermal head 36, and reset to zero when a red ink 13*r* region is in confrontation with the thermal head 36. The RAM 100 also includes a memory for temporarily storing results of calculations made in the CPU 97.

Next, an explanation of a print position initialization control routine and a label production control routine performed in the control device CD of the tape printer 1 will be provided while referring to the flowcharts in FIGS. 15 through 19. Individual steps will be referred to as Si (wherein i=10, 11, 12 and so on).

Figure 13:
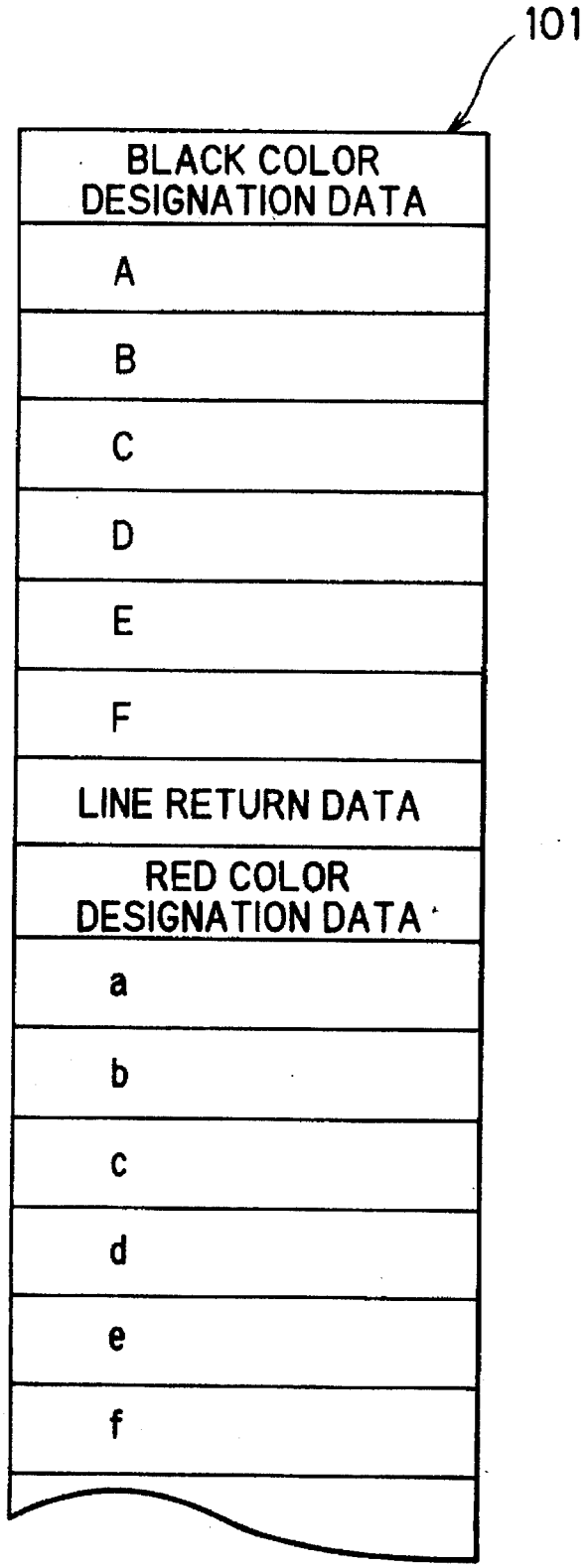
FIG. 13 is an explanatory view of a text memory storing color-designation data and character string codes.

Assume that when this control routine is started, as shown in FIG. 13, black and red color-designation data are respectively added to code data for the two lines of character strings "ABCDEF" and "abcdef" desired to be printed on a print tape, and stored in the text memory 101 as text data for a single block (a first block).

Further assume that a tape cassette 10 housing a two-color (i.e., black and red) ink ribbon 13 and a receptor-type print tape 12 is loaded in the thermal printing mechanism PM. The front margin amount FY and the rear margin amount RY desired to be provided respectively at the front edge and at the rear edge of each tape-shaped label produced in the thermal printing mechanism PM are previously determined using the keyboard 2. The maximum length of each tape-shaped label is restricted to about 20 cm.

Figure 14:
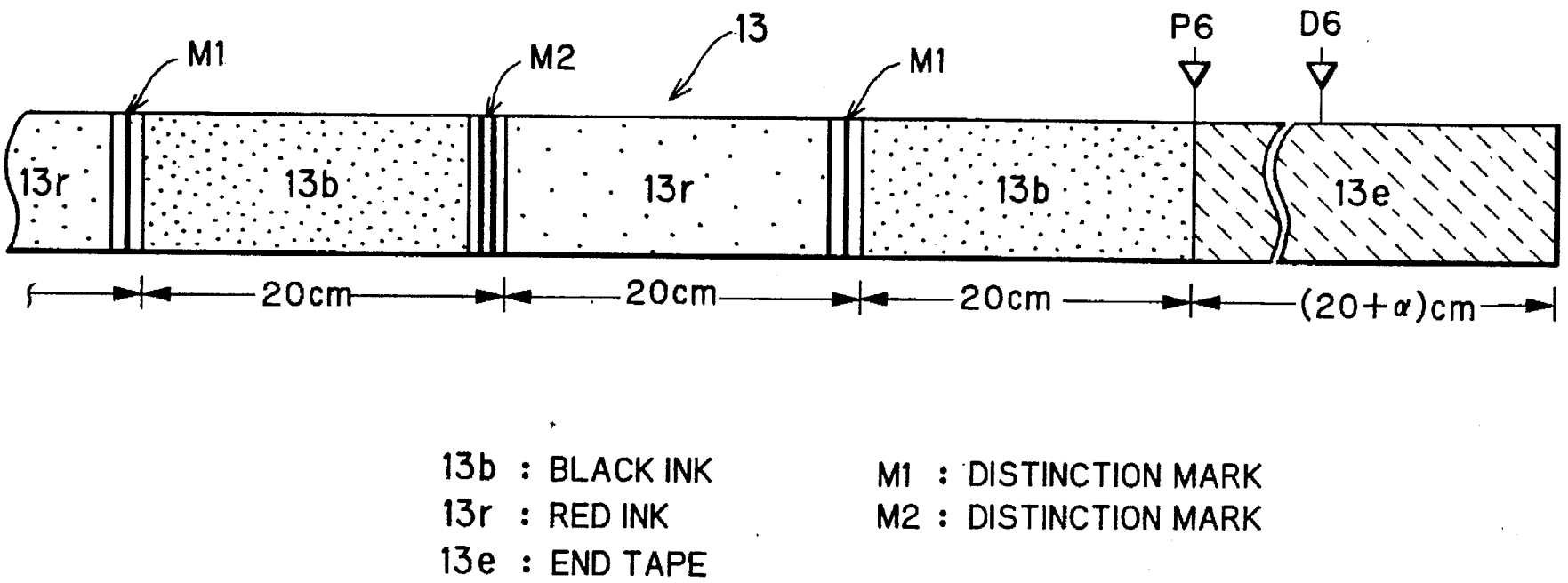
FIG. 14 is a planar view of an ink ribbon.

As shown in FIG. 14, the ink ribbon 13 is coated alternately with black ink **13*b* and red ink 13*r* regions that are a predetermined length B. The predetermined length is 20 cm in this example. A single barcode-shaped distinction mark M1 is marked at the starting edge of each black ink 13*b* color region. A double barcode-shaped distinction mark M2 is marked at the starting edge of each red ink 13*r* color region. An end tape 13*e* having silver foil adhered thereto for demarcating the end edge of the ink ribbon 13 is connected to the end edge of the ink ribbon 13. The end tape 13*e* is longer than the black ink 13*b* and the red ink 13*r*** coated regions, that is, longer than the predetermined length B (20 cm) by an amount $\alpha$ of, for example, 5 to 10 cm.

When producing the ink ribbon 13, a transparent base for the ink ribbon is coated with red and black inks alternately. The starting edge of each ink region is not coated with the corresponding ink, but remained transparent. The barcode-shaped mark is coated on that transparent region.

Figure 15:
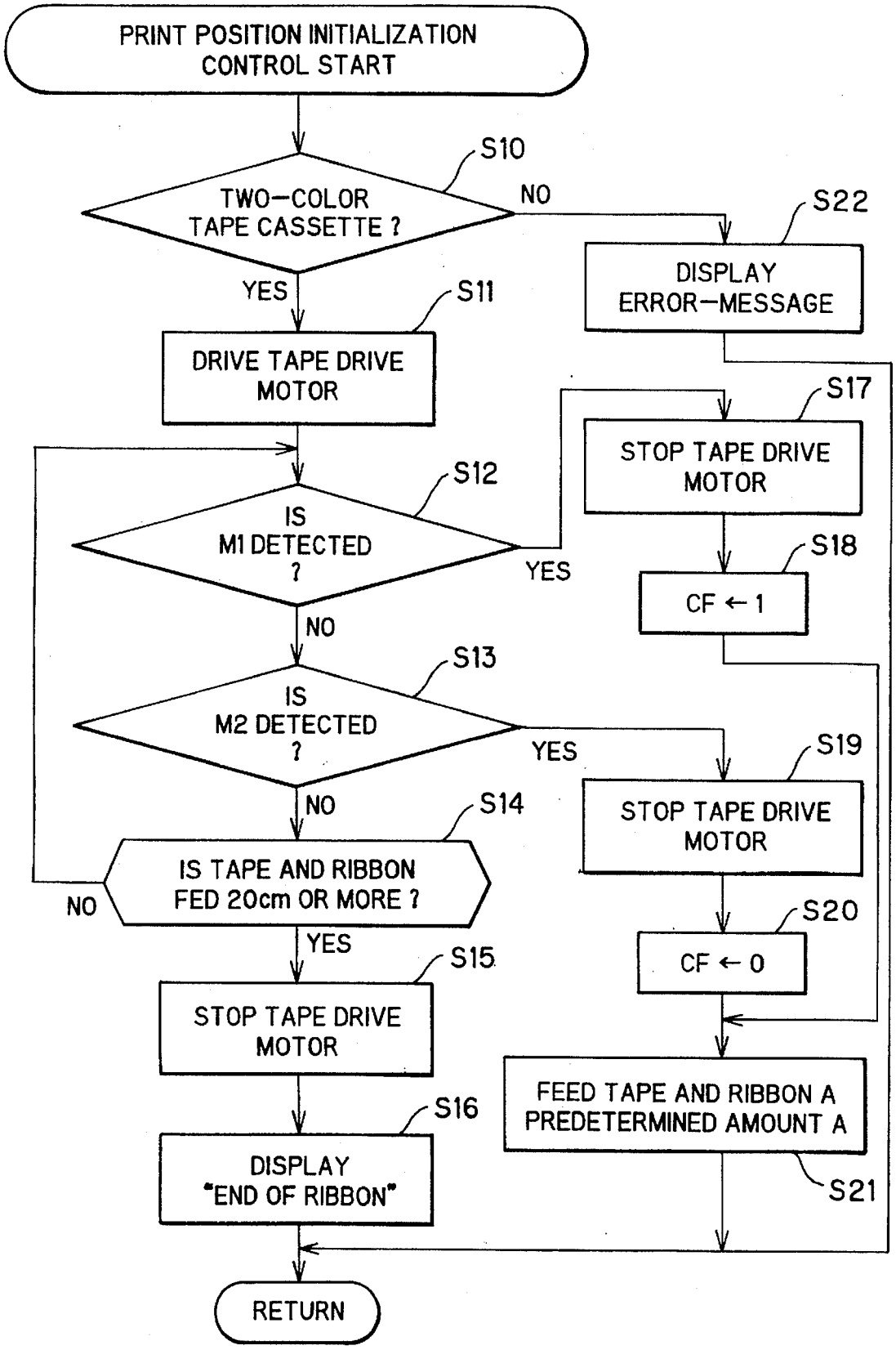
FIG. 15 is a flowchart schematically representing a print position initialization control routine.
Figure 16:
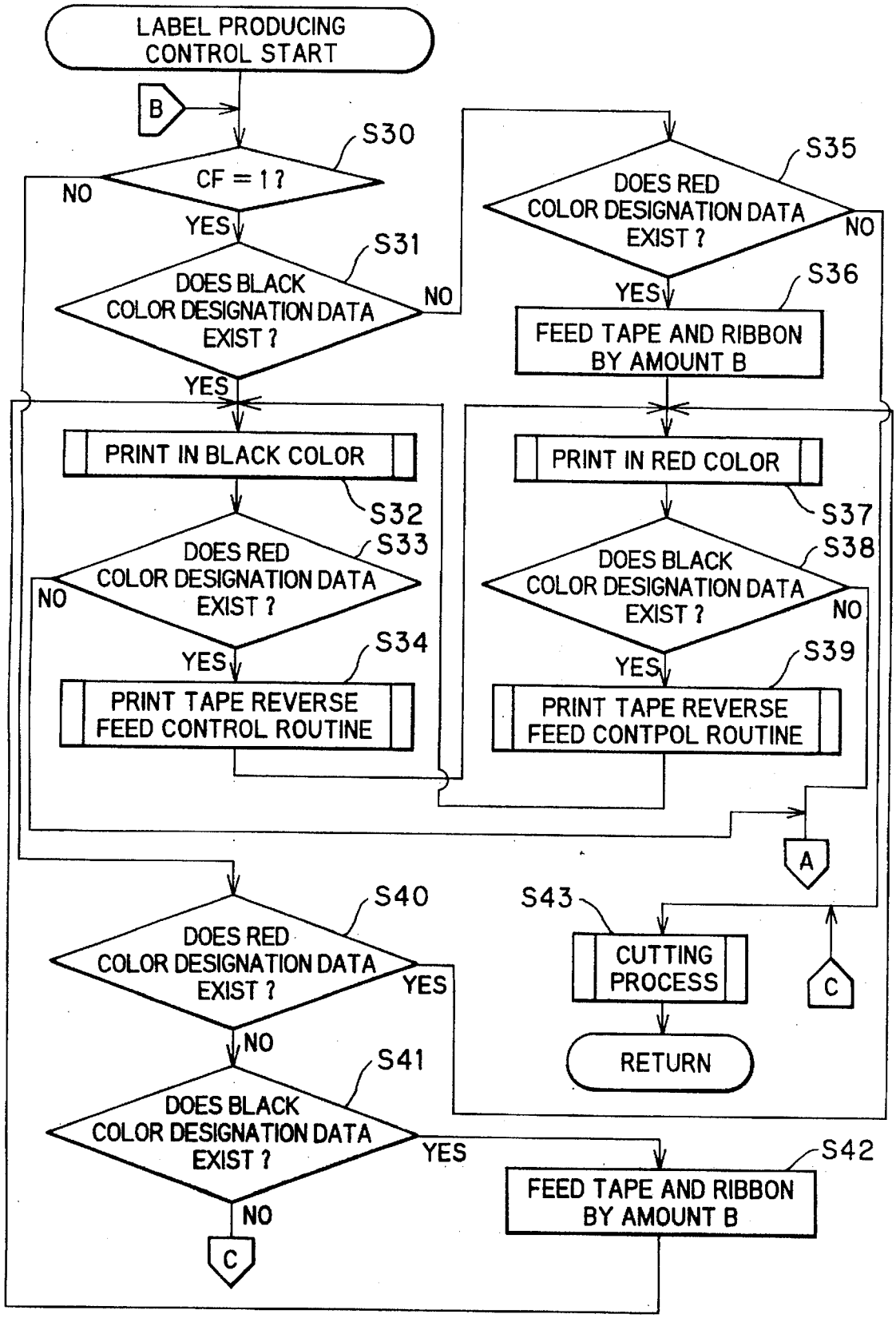
FIG. 16 is a portion of a flowchart schematically representing a label producing control routine.

Next, an explanation of the print position initialization control routine for aligning the print position P of the thermal head 36 with the starting edge of the black ink **13*b* or the red ink 13*r* of the ink ribbon 13 will be provided while referring to FIG. 15**.

This control routine is started when the power source of the tape printer 1 is turned on, or when a tape cassette 10 is loaded into the tape printer 1. More specifically, this control routine is started, when the power switch on the key board 2 is turned ON, or when the cassette switch 37 detects that a tape cassette 10 is loaded into the tape printer by at least one of detection signals from the fifth and sixth detection switches turning from OFF to ON.

During this control routine, when a two-color tape cassette 10 is determined to be loaded in the tape printer 1 (S10:YES), the tape drive motor 39 is driven at a slow speed (S11). At this time, as shown in FIGS. 3 and 8, the print tape 12 and the ink ribbon 13 are fed in synchronization by rotation of the tape feed roller 18 and the pressure roller 58. The determination in S10 is based on detection signals from the first through sixth detection switches of the cassette switch 37 and the cassette type determination table TB. For example, a YES determination in S10 could be produced by an ON detection signal from the first detection switch accompanied with an OFF detection signal from the second detection switch.

S12 through S14 are repeatedly performed as long as, based on the detection signals from the detection sensor 33, no color-distinction signal corresponding to the single barcode-shaped distinction mark M1 of a black ink **13*b* region is detected (S12:NO) and no color-distinction signal corresponding to the double barcode-shaped distinction mark M2 of a red ink 13*r* region is detected (S13:NO), and as long as the print tape 12 and the ink ribbon 13** have not been fed 20 cm since the start of feeding operations (S14:NO).

When a color-distinction signal corresponding to the distinction mark M1 is detected (S12:YES), feed of the print tape 12 and the ink ribbon 13 are stopped by stopping drive of the tape drive motor 39 (S17) and the color flag CF is set to one because the black ink **13*b* will be moved into confrontation with the thermal head 36 (S18). Further, the tape drive motor 39 is driven a predetermined number of steps to feed the print tape 12 and the ink ribbon 13 in synchronization a predetermined amount A (for example, 6.5 cm) corresponding to the distance from the detection sensor 33 and the thermal head 36 along the transport path of the ink ribbon 13** (S21). The program then returns to the main routine.

Figure 20:
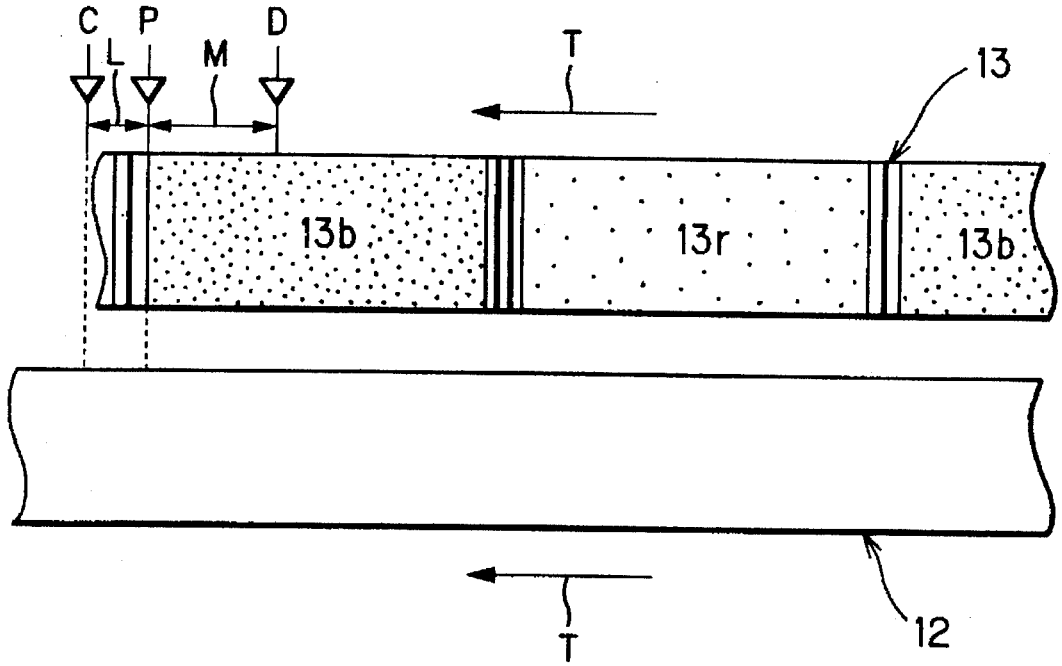
FIG. 20 is an explanatory view for explaining the correspondence relationship of the print position, the ink ribbon, and the print tape at the start of printing.

As a result, as shown in FIG. 20, the starting edge of the black ink **13*b* is positioned at the print position P of the thermal head 36. In this drawing, the letter C indicates a cutting position cut by cooperative movement between the fixed blade 81 and the mobile blade 83 and the letter D indicates a detection position detected by the detection sensor 33**. Also, the letter L indicates the distance (for example, about 2.0 cm) between the print position P and the cutting position C and the letter M indicates a distance between the detection position D and the print position P. The distance M is, for example, slightly less than 6.5 cm and is slightly smaller than the predetermined amount A.

On the other hand, when a color-distinction signal corresponding to an distinction mark M2 is detected (S12:NO, Si3:YES), the drive of the tape drive motor 39 is stopped (S19) and the color flag CF is reset to zero because a red ink **13*r* region will be in confrontation with the thermal head 36 (S20). Further, the print tape 12 and the ink ribbon 13** are fed in synchronization by the predetermined amount A (S21). The program then returns to the main routine.

If at the time the routine is started a two-color tape cassette 10 is not loaded in the thermal printing mechanism PM (S10:NO), an error message "A two-color tape cassette is not loaded" will appear on the display 3 (S22) and the program will return to the main routine.

When no color-distinction signal corresponding to a distinction mark M1 or a distinction mark M2 are detected, but the print tape 12 and the ink ribbon 13 have been fed more than 20 cm since the start of feed processes (S14:YES), the drive of the tape drive motor 39 is stopped (S15) and, because the ink ribbon 13 has been used to its end, an error message reading "End of Ribbon" will be displayed on the display 3 (S16). The program then returns to the main routine.

Figure 21:
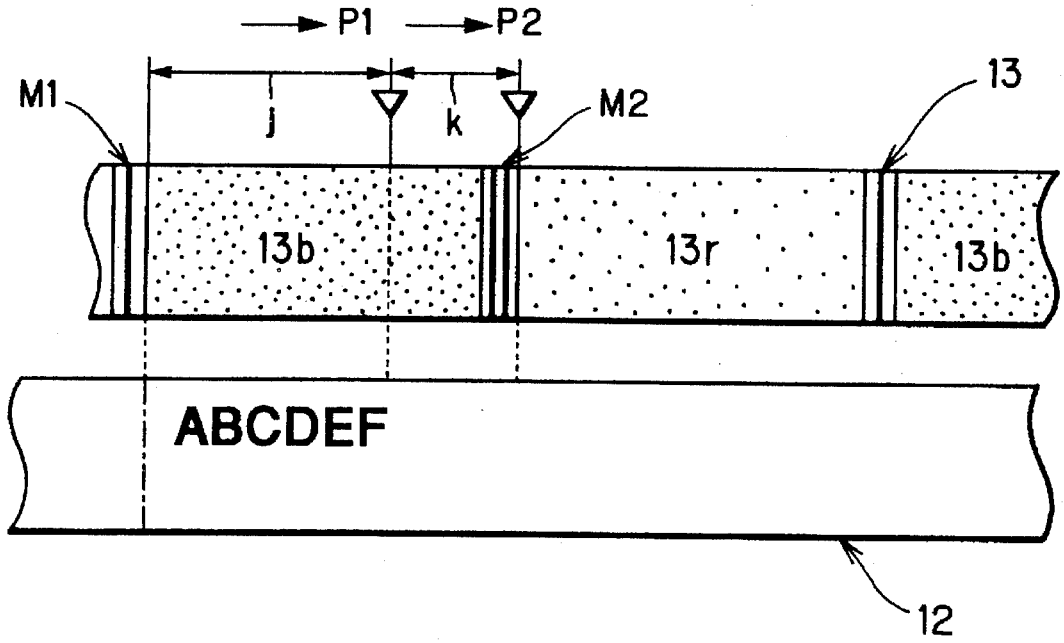
FIG. 21 is a view corresponding to FIG. 20 when a first row of a character string is printed in black ink.

Next, an explanation of the label producing control routine will be provided while referring to FIGS. 16 through 19. This program is started when a label production key is operated on the keyboard. When the color flag CF is set to one and it is determined that the starting edge of a black ink **13*b* region is aligned with the print position P of the thermal head 36 (S30:YES), and when black color designation data exists in the text data of the text memory 101 (S31:YES), dot pattern data for the character string indicated by the black color designation data is developed and stored in the print buffer 102 and the dot print data is serially printed on the print tape 12 by the thermal head 36 (S32). For example, as shown in FIG. 21, the character string "ABCDEF" indicated by black color designation data is printed on the first row of the print tape 12 in black ink 13***b*. As shown in FIG. 21, the print position P1 at the end of this printing is positioned to the right of the final character "F".

Figure 18:
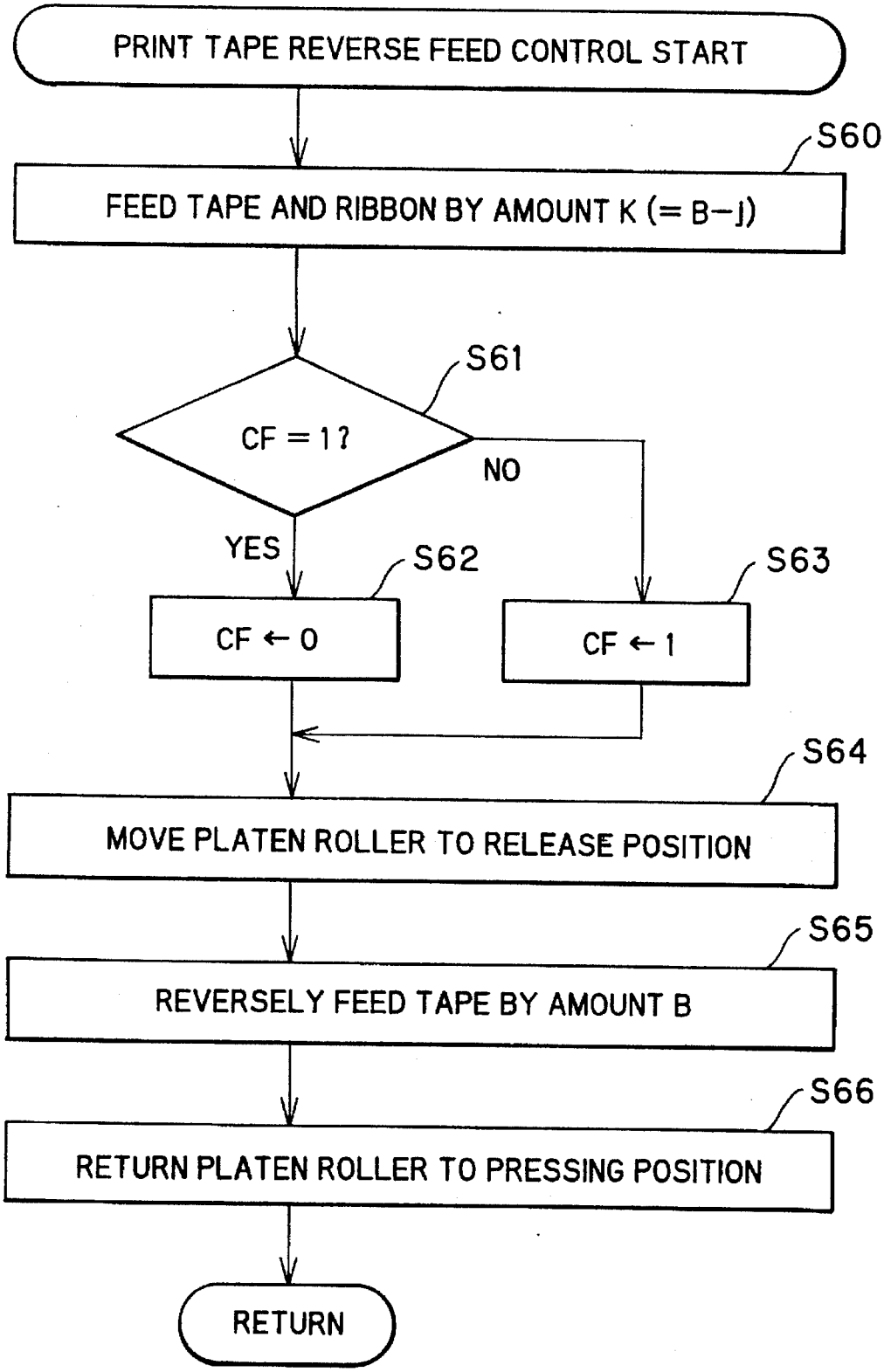
FIG. 18 is a flowchart schematically representing a print tape reverse feed control routine.
Figure 19:
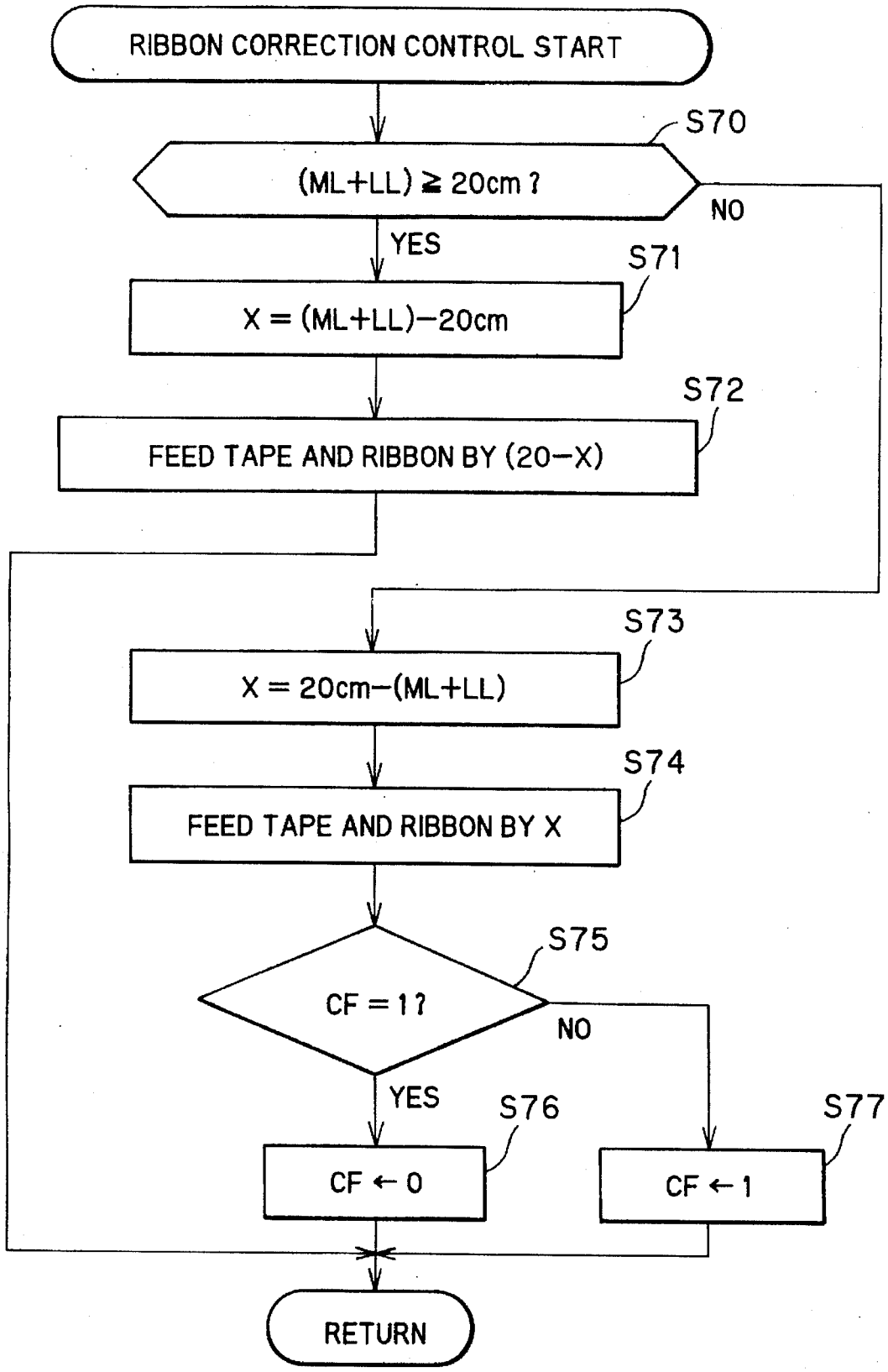
FIG. 19 is a flowchart schematically representing a ribbon position correction control routine.

When the red color designation data exists in the print data in the same block of the text memory 101 (S33:YES), the print tape reverse feed control routine shown in FIG. 18 is executed (S34) to print the character string in red from the print starting position of the first block.

When this routine is started, as shown in FIG. 18, a remaining ink ribbon feed amount k is determined in order to print using the next red ink 13*r* region. The remaining ink ribbon feed amount k is determined by subtracting the feed amount of the print tape 12 when print processes were performed in S32, that is, the ink ribbon feed amount j (see FIG. 21) that the ink ribbon 13 was fed during print processes, from the predetermined amount B (20 cm, in this embodiment). Afterward, the print tape 12 and the ink ribbon 13 are fed by the remaining ink ribbon feed amount k (S60). As a result, the print position P2 is positioned at the starting edge of the next red ink 13*r* region. Thus, the ink ribbon has been totally fed by the predetermined amount B so that the print position has moved from P via P1 to P2.

As a result, the ink color in confrontation with the thermal head 36 changes. Accordingly, when the color flag CF has been set to one (S61:YES), the color flag CF is reset to zero (S62). On the other hand, when the color flag CF has not been set (S61:NO), the color flag CF is set to one (S63). Next, the platen moving motor 71 is driven so that, as shown in FIG. 9, the platen association lever 77 moves maximally to the right and the platen roller 55 is moved to the release position (S64). Next, the tape drive motor 39 is driven to rotate in reverse a predetermined number of steps so that only the print tape 12 is fed in reverse by the predetermined amount B (S65). Afterward, the platen moving motor 71 is further driven so that, as shown in FIG. 8, the platen association lever 77 is moved maximally to the left and the platen roller 55 is returned to the pressing position (S66) for pressing the tape 12 and the ink ribbon 13 against the print head 36. This routine is then completed and the program returns to S37 of the label production control routine.

Figure 22:
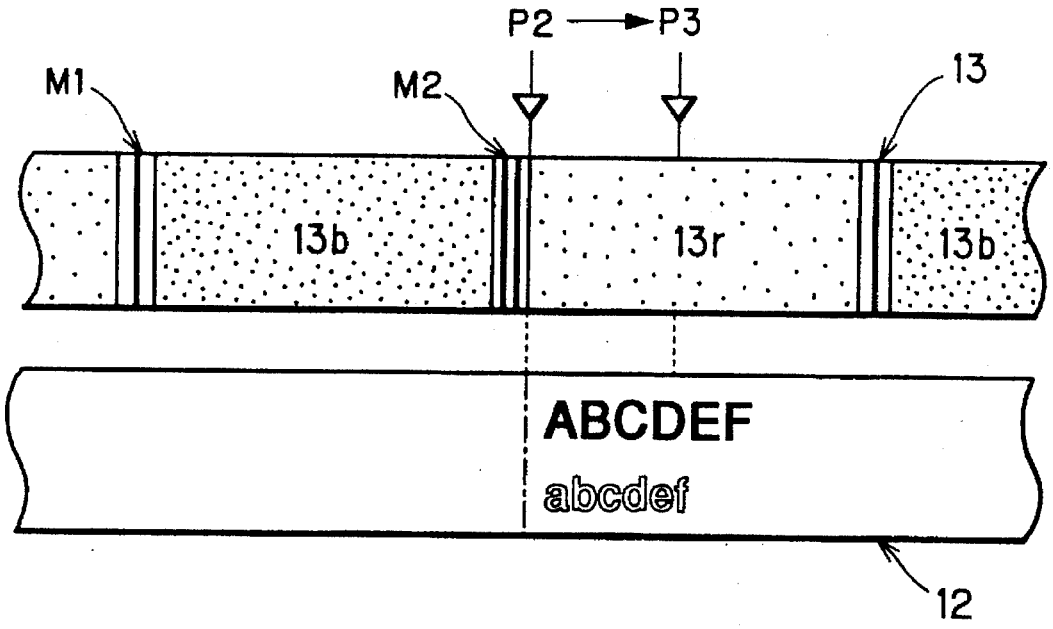
FIG. 22 is a view corresponding to FIG. 20 when a second row of a character string is printed in red ink.

Next, in S37, dot pattern data for the character string indicated by red-color designation data is developed and stored in the print buffer 102 and the dot pattern data is serially printed on the second row of the print tape 12 using the thermal head 36. For example, as shown in FIG. 22, the character string a to f indicated by red-color designation data is printed at the second row of the print tape 12 in red ink 13*r*. The print position P3 at the completion of printing is to the right of the final character "f" as shown in FIG. 22.

Figure 17:
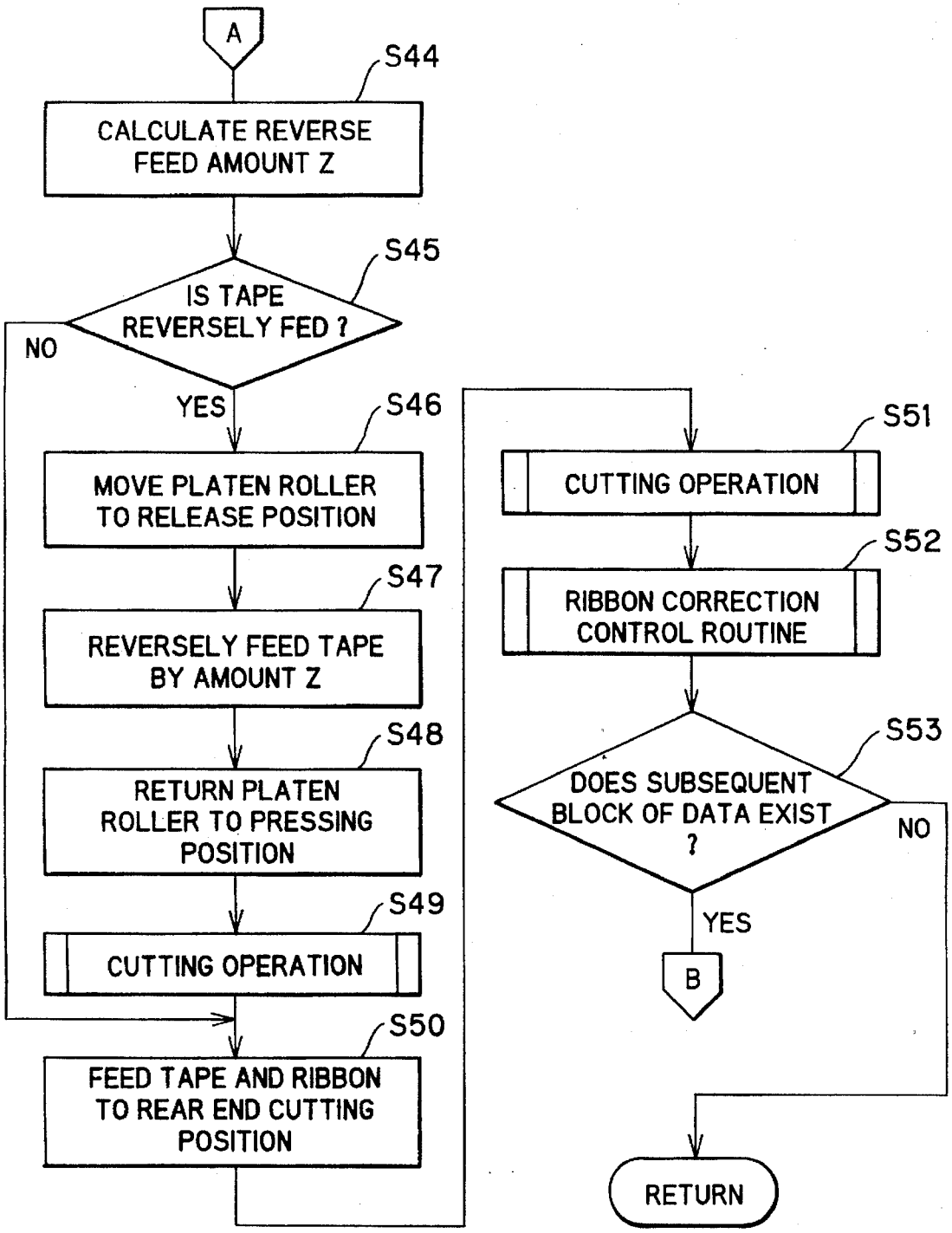
FIG. 17 is a remaining portion of the flowchart schematically representing the label producing control routine.

When no black-color designation data exists in the print data of the same block of the text memory 101 (S38:NO), S44 and on shown in FIG. 17 are executed. The front portions and the rear portions are cut to produce a two-color label having this text data across these two rows.

When the color flag CF is set to one (S30:YES), and red-color designating data exists (S31:NO, S35:YES), the print tape 12 and the ink ribbon 13 are fed the predetermined amount B so that the starting edge of the red ink 13*r* will be at the print position P of the thermal head 36 (S36). Then, the character string indicated by the red-color designation data is serially printed on the print tape 12 by the thermal head 36 (S37) and S38 and on are executed.

On the other hand, if at the start of this routine the color flag CF is not set to one and the starting edge of a red ink 13*r* region is aligned with the print position P of the thermal head 36 (S30:NO), and if color-designation data for the color red is present in the text data (S40:YES), then S37 and on are executed. However, if color-designation data for the color black is present in the text data (S40:NO, S41:YES), then the print tape 12 and the ink ribbon 13 are fed the predetermined amount B so that the starting edge of the black ink 13*b* is aligned with the print position P of the thermal head 36 (S42). Then, the character string indicated by the color-indication data for the color black is serially printed on the print tape 12 by the thermal head 36 in the manner described previously (S32) and S33 and on are performed.

If no color-designation data for the colors red or black exists in the text data (S31 and S35:NO; or S40 and S41:NO), then the cutting motor 84 is driven so that the print tape 12 is cut by reciprocal movement of the mobile blade 83 (S43), whereupon this routine is completed and the program returns to the main routine.

In S44, a tape reverse feed amount Z, for cutting the front edge of the tape so that the resultant label is provided with the front margin amount FY, is determined by the following calculation:

$$Z=(L-FY)-ML$$

wherein

Figure 23:
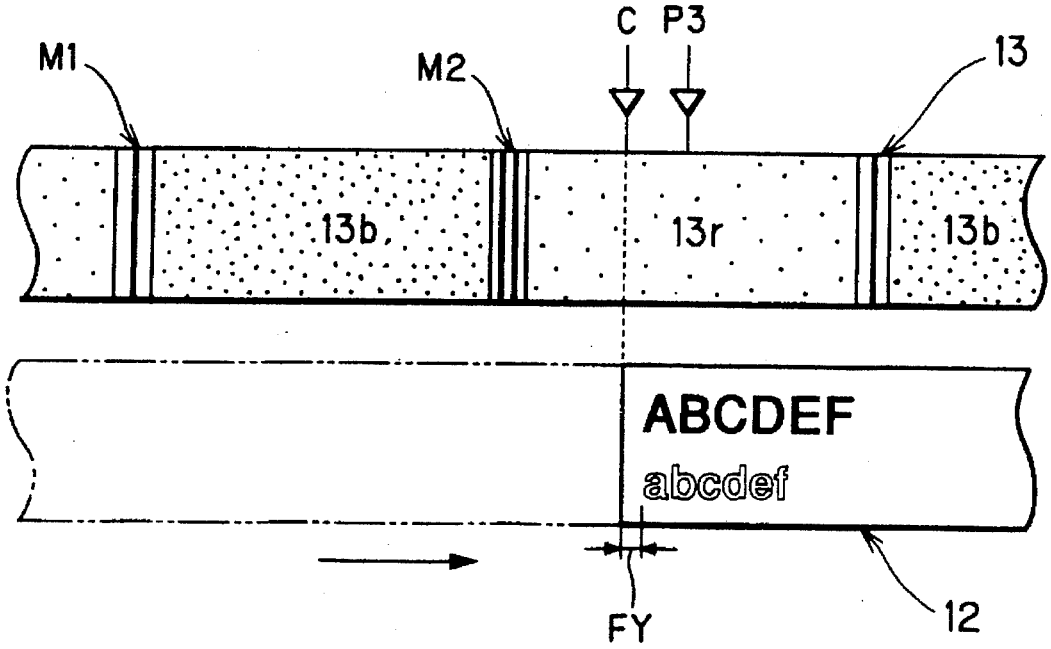
FIG. 23 is a view corresponding to FIG. 20 when a front edge of a tape-shaped label is cut.

L=distance between printing and cutting positions,

ML=print length of the final character row. If the tape reverse feed amount Z is a negative number and the print tape 12 should be reversely fed (S45:YES), then the platen moving motor 71 is driven so that the platen association lever 77 moves maximally to the right and the platen roller 55 moves to the release position (S46). Then, the print tape 12 only is reversely fed the tape reverse feed amount Z by reverse rotation of the tape drive motor 39 (S47). The platen moving motor 71 is driven so that the platen association lever 77 is moved maximally to the left and the platen roller 55 is moved back to the pressing position (S48). Then, the cutting motor 84 is driven so that the print tape 12 is cut by reciprocal movement of the mobile blade 83 (S49). For example, as shown in FIG. 23, the print tape 12 is cut with a front margin amount FY after being fed by the tape reverse feed amount Z.

Figure 24:
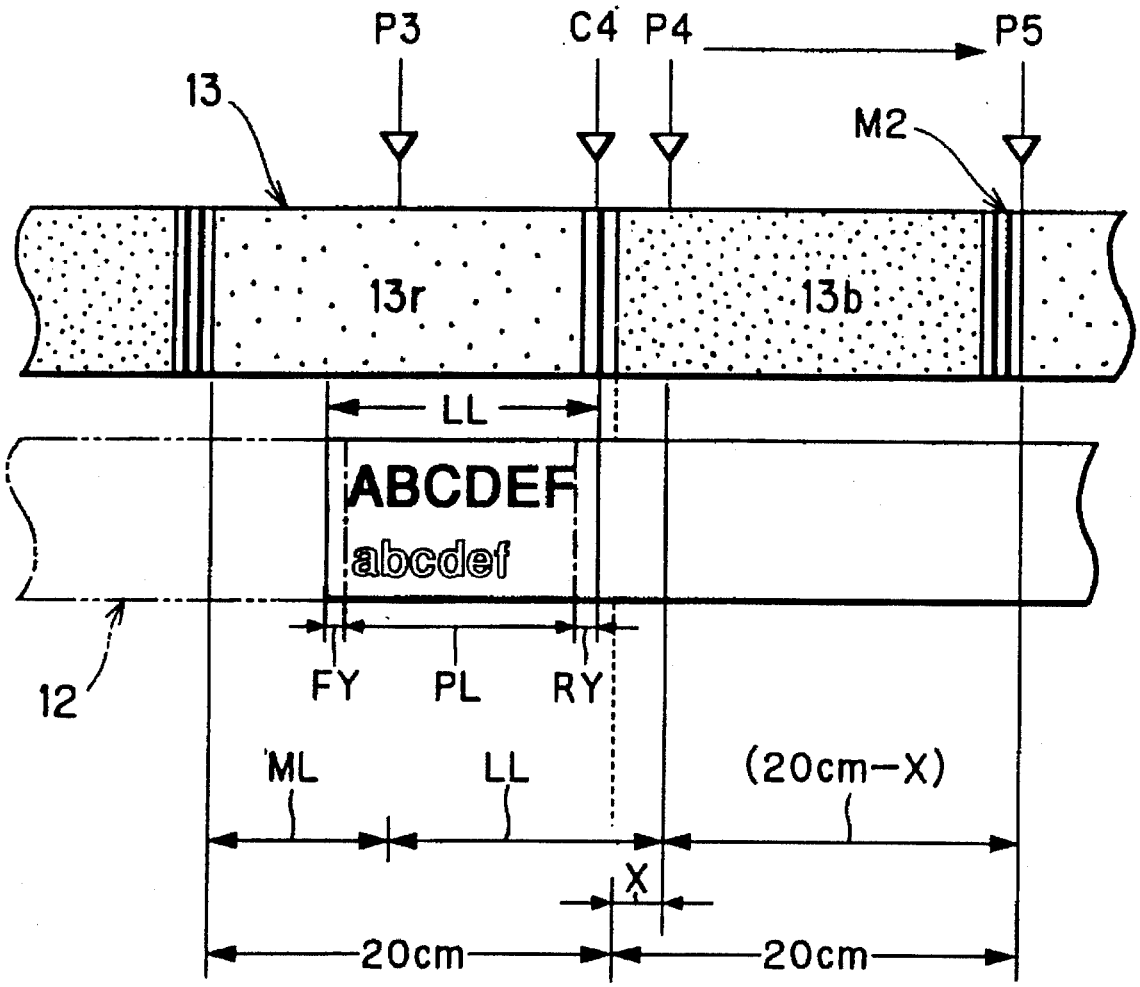
FIG. 24 is a view corresponding to FIG. 20 when a rear edge of a tape-shaped label is cut and when the ribbon position for the next printing is corrected.

Next, the print tape 12 and the ink ribbon 13 are fed until a rear end cutting position (S50). Then the print tape 12 is cut at the end edge cutting position (S51). For example, as shown in FIG. 24 the print tape 12 and the ink ribbon 13 are fed a label length LL determined by adding the front margin amount FY, the maximum character length PL in this block, and the rear end margin amount RY, and the print tape 12 is cut at the rear end cutting position. The print position at this point is P4 and the cutting position at this point is C4.

Next, a ribbon correction control routine for correcting the ink position of the ink ribbon 13 so that the print position P is aligned with the starting edge of the next ink region is executed (S52). The ribbon correction control routine is represented by the flowchart in FIG. 19.

At the start of this routine, if the total distance that the ink ribbon 13 was moved is 20 cm or more as determined by adding the character length of the final character row ML to the label length LL, that is, if the present print position P is aligned with the next different ink color region (S70:YES), then a variable X is determined (S71) by the following formula also shown in the drawing:

$$X=(ML+LL)-20.$$

Then, the print tape 12 and the ink ribbon 13 are fed by a length determined by subtracting the variable X from 20 cm, which is the length of the black ink 13*b* or red ink 13*r* region (S72). Then this routine is completed and the program returns to S53 of the label production control routine. As a result, the print position P5 is aligned with the starting edge of the next red ink 13*r* as shown in FIG. 24. In this case, the ink color corresponding to the print position P5 will be the same as the red ink 13*r* at the end of printing.

On the other hand, when the ink ribbon 13 has been fed a total amount less than 20 cm (S70:NO), the variable X is determined (S73) by the following formula:

$$X=20-(ML+LL),$$

and the print tape 12 and the ink ribbon 13 are fed by an distance equal to the variable X (S74). Next, because the ink color corresponding to the print position P5 is different from the ink color at the completion of printing in this case, when the color flag CF has been set to one (S75:YES), the color flag CF is reset to zero (S76). On the other hand, when the color flag CF has not been set to one (S75:N0), the color flag CF is set to one (S77). Then, this control routine is completed and the program returns to S53 in the same way as described previously.

When a subsequent block of data exists in the text memory 101 during the label production control routine (S53: Yes), S30 and on are repeatedly executed. When a subsequent block of data does not exist in the text memory 101 (S53: No), this control routine is completed and the program returns to the main routine.

Operations for controlling ribbon feed amount and controlling ink color determination included in the above-described print position initialization process and label production process will be described.

The black and red, two-color ink ribbon 13 is coated alternately with black ink 13*b* and red ink 13*r* each at a predetermined length of 20 cm. Further, a single barcode-shaped distinction mark M1 is marked at the starting edge of each black ink 13*b* color region and two barcode-shaped distinction marks M2 are marked at the starting edge of each red ink 13*r* color region. Only one time when the tape cassette is loaded in the tape-shaped label producing device or directly after power is turned on, the detection sensor 33 detects the ink color of the ink ribbon 13. The print tape 12 and the ink ribbon 13 are fed a distance M between the detection position and the printing position, for example, 6.5 cm, so that the starting edge of the detected ink color is brought into confrontation with the printing position P of the thermal head 36. Afterwardly, the ink color at the printing position P is determined according to the flag data of the color flag CF and based on the length of ink coated regions, that is, 20 cm, on the order of juxtaposition of the red and black ink colors, and on the amount the ink ribbon 13 is fed after detection. Therefore, the ink color detecting-and-determining processes can be eliminated during printing processes. This reduces the load on the CPU 97 of the control device CD so that printing can be accurately and quickly performed in the designated ink color.

Further, before printing processes are performed, the ink ribbon 13 is fed so that the designated color ink is brought into confrontation with the print position P based on the flag data of the color flag CF and on the color designation data of the character string to be printed. Therefore, the ink color of the ink ribbon 13 can be accurately brought into confrontation with the print position P regardless of whether the red or black color ink of the two colors of ink are commanded.

Next, an explanation of operations of a tape cutting routine included in the above-described label producing routine will be provided.

After printing of the character strings "ABCDEF" and "abcdef" of the first block using black ink 13*b* and red ink 13*r*, tape reverse feed amount Z from the present printing position P is calculated for cutting the front edge of the produced label so that the label is provided with a margin amount FY. The platen movement motor 71 drives the platen association lever 77 to move the platen roller 55 into the release position. While the platen roller 55 is in the release position, the tape drive motor 39 is driven to rotate in reverse so that the print tape 12 only is reversely supplied by the tape reverse feed amount Z. The platen movement motor 71 is further driven so that the platen roller 55 is moved back into the pressing position. Then, the cutting motor 84 is driven so that the front edge position of the print tape is cut by reciprocal movement of the movable blade 83. This is performed without any reduction in performance of printing processes. Also, no characters, printed on the print tape 12 using the ink on the ink ribbon 13, are cut. The print tape 12 is cut without any adverse effect to the quality of printed characters.

Providing the platen roller 55 so as to press the ink ribbon 13 and the print tape 12 against the thermal head 36 and so as to be switchable between a pressing position and a release position is a much simpler mechanism and structure than providing the thermal head 35, with its plurality of connection lines for supplying print data, switchable between the pressing position and the release position.

As described above, in the tape-shaped label producing device of the present invention, the ink ribbon is cyclically coated, in a predetermined order, with regions having a predetermined length so that adjacent regions are of a different color of a plurality of colored inks, and ink-distinction marks are marked at a starting edge of each region coated with a same color ink. Either when the tape cassette is loaded in the tape-shaped label producing device or directly after power is turned on, the tape feed mechanism and the ribbon feed mechanism are driven so that the tape and the ink ribbon are fed in synchronization in a printing direction. At this time, the ink-color detection sensor uses the distinction marks to detect the ink color of the ink ribbon at a standard position that is a predetermined distance upstream from the print head. From this, the ink-color determination unit determines the ink color at a printing position, based on the ink color that has been detected by the ink-color detection sensor either when the tape cassette is loaded in the tape-shaped label producing device or directly after power is turned on, and a post-detection ink ribbon feed amount.

In this way, the ink color of the ink ribbon is detected once either when the tape cassette is loaded in the tape-shaped label producing device or directly after power is turned on. The tape and the ink ribbon are fed according to a predetermined distance so that the starting edge of the detected ink color can be brought into confrontation with the printing position. The ink color at the printing position can be determined based on the length of regions on which ink is coated, on the order of ink colors; and on the amount the ink ribbon is fed after detection of ink color. Therefore, the ink-color detection-and-determination control can be eliminated during control of printing processes. This reduces the load on the CPU of the control device during printing processes so that printing can be accurately and quickly performed in designated colors.

A ribbon feed control mechanism is further provided for controlling the ribbon feed mechanism so that the ink ribbon with an ink color commanded by the printing control unit is fed to the printing position, based on the ink color determined by the ink-color determining unit and on the ink ribbon feed amount. Therefore, regardless of which of the plurality of ink colors is designated, the designated ink color of the ink ribbon can be accurately brought into confrontation with the printing position.

As described above, the tape-shaped label producing device according to the present invention includes a printing unit having a print head, a tape cutting mechanism, and a printing control unit for controlling these components. The tape-shaped label producing device may further include a ribbon feeding mechanism. A platen roller and a movement mechanism are provided to the printing unit. A cutting control unit is further provided to the device. After print data of one block has been printed, the tape is fed in a reverse printing direction a predetermined amount determined from the print data and the edge margin length. Then the tape is cut. Tape-shape labels can be produced without any reduction in performance of printing processes. Also, no characters printed on the print tape are cut. The print tape is cut without any adverse effect to the quality of printed characters.

The platen roller is structured to press the tape (and the ink ribbon) against the print head. The movement mechanism includes a platen drive mechanism for switching the platen roller between the pressing position and a release position. This structure is simpler than one capable of switching the print head, with its plurality of connection lines for supplying print data, between the pressing position and the release position.

While the invention has been described in detail with reference to the specific embodiment thereof, it would be apparent to those skilled in the art that various changes and modifications may be made therein without departing from the spirit of the invention, the scope of which is defined by the attached claims.

For example, the ink ribbon 13 may be cyclically coated with two or more different colored inks, such as black, red and green inks, in a predetermined order. The ink ribbon 13 may be provided with a distinction mark at the starting edge of each different colored ink region.

The thermal head 36 could be structured to be capable of being switched between the pressing position and the release position. Also, the print tape 12 could be a tape made from thermal paper that can be reversely fed.

The present invention can be applied to any tape printer having a dot-type print mechanism for printing print tape 12 using ink ribbon 13. Additionally, the present invention can be applied to various type of tape-shaped label producing devices provided with dot format printing mechanisms for printing on print tape made from thermal paper, without use of an ink ribbon 13.

What is claimed is:

1. A tape-shaped label producing device, comprising:

mounting means for mounting a tape cassette which houses an ink ribbon and a tape serving as a print medium, the ink ribbon being formed by coating, cyclically in a predetermined order, regions of a predetermined length with different colors of a plurality of colored inks;

printing means including a print head for printing on the tape via the ink ribbon at a printing position;

tape feeding means for feeding the tape in a printing direction;

ribbon feeding means for feeding the ink ribbon in the printing direction in synchronization with the tape;

printing control means for controlling the printing means, the tape feeding means, and the ribbon feeding means;

ink color detection means for detecting an ink color region of the ink ribbon prior to commencing printing; and ink-color determining means determining ink color at the printing position, based on an ink color detected by the ink color detection means and a post-detection ink ribbon feed amount, with which the ink ribbon is fed by the ribbon feed means after the ink color is detected.

2. A tape-shaped label producing device as claimed in claim 1, further comprising a ribbon feed control means controlling the ribbon feeding means so that the ink ribbon with an ink color designated by the printing control means is fed to the printing position, based on the ink color determined by the ink-color determining means and on the ink ribbon feed amount.

3. A tape-shaped label producing device as claimed in claim 1, wherein the ink color detection means detects the ink color region, when the tape cassette is loaded in the mounting means.

4. A tape-shaped label producing device as claimed in claim 1, wherein the ink color detection means detects the ink color region, directly after power is turned on.

5. A tape-shaped label producing device as claimed in claim 1, wherein the ink-color determining means determines ink color at the printing position, based on the ink color detected by the ink color detection means, the post-detection ink ribbon feed amount, with which the ink ribbon is fed by the ribbon feed means after the ink color is detected, and the order of juxtaposition of the ink colors.

6. A tape-shaped label producing device as claimed in claim 5, wherein the ink color detection means includes mark sensor means for detecting ink color of the ink ribbon based on an ink-distinction mark provided at a starting edge of each region coated with a corresponding color ink.

7. A tape-shaped label producing device as claimed in claim 6, wherein the ink-distinction mark is a barcode shaped mark, and wherein the mark sensor means includes light-generating means and light-receiving means which are positioned at the position, the ink ribbon fed by the ribbon feeding means passing between the light-generating means and light-receiving means.

8. A tape-shaped label producing device as claimed in claim 1, further comprising tape reversely feeding means for feeding the tape in a reverse printing direction, the printing control means controlling the tape reversely feeding means to reversely feed the tape a desired distance when the ink-color determining means determines ink color at the printing position, thereby allowing a desired position on the tape to be printed with the determined ink color.

9. A tape-shaped label producing device as claimed in claim 8, further comprising:

switching means for switching at least one of a platen roller and the print head between a pressing position wherein the tape and the ink ribbon are pressed between the print head and the platen roller and a release position wherein the platen roller and the print head are separated from each other, the switching means switching at least one of the platen roller and the print head in the pressing position when the tape feed means and the ribbon feed means feed the tape and the ink ribbon in the printing direction and the switching means switching at least one of the platen roller and the print head in the release position when the tape reversely feeding means feeds the tape in the reverse printing direction.

10. A tape-shaped label producing device as claimed in claim 8, further comprising spacing means for spacing the print head and a platen roller, the printing control means controlling the spacing means to space the print head and the platen roller when the tape reversely feeding means reversely feeds the tape.

11. A tape-shaped label producing device as claimed in claim 8, wherein the printing control means includes calculating means for calculating the desired distance with which the tape is desired to be reversely fed to allow the desired position on the tape to be located at the printing position.

12. A tape-shaped label producing device as claimed in claim 1, wherein the ink color detection means is provided at a position that is a predetermined distance from the printing position for detecting ink colors of the ink ribbon that arrive at the position; and feed control means for controlling the tape feeding means and the ribbon feeding means to feed the tape and the ink ribbon in the printing direction until the ink color detection means detects an ink color.

13. A tape-shaped label producing device for producing a tape-shaped label through printing on a tape with an ink ribbon formed with a plurality of colored ink regions arranged in a predetermined order, the device comprising:

detecting means for detecting ink color of a colored ink region of an ink ribbon which is located at a detecting position prior to commencing printing, the ink ribbon being formed with a plurality of colored ink regions arranged in a predetermined order, each colored ink region having a predetermined length;

feeding means for feeding the tape and the ink ribbon in a printing direction in synchronization with each other with an amount which is determined, based on the detection result, so as to cause a colored ink region of a desired ink color to be positioned at a printing position; and a printing head located at the printing position for printing the tape with the colored ink region located at the printing position.

14. A tape-shaped label producing device as claimed in claim 13, further comprising a tape cassette receiving portion for installing a tape cassette therein, the tape cassette housing the tape and the ink ribbon formed with the plurality of colored ink regions.

15. A tape-shaped label producing device as claimed in claim 14, further comprising reversely feeding means for feeding the tape in a reverse printing direction with another amount causing a desired point of the tape to return to the printing position, the reversely feeding means reversely feeding the tape without reversely feeding the ink ribbon.

16. A tape-shaped label producing device as claimed in claim 15, further comprising calculating means for calculating the other amount, with which the tape is desired to be reversely fed to cause the desired point of the tape to be positioned on the printing position, the calculating means calculating the amount based on an amount with which the tape has been fed by the feeding means.

17. A tape-shaped label producing device as claimed in claim 16, wherein the calculating means further calculates the amount with which the tape and the ink ribbon are desired to be fed in the printing direction to cause the desired ink color of the ink ribbon to be positioned at the printing position, the calculating means calculating the amount based on a distance between the detecting position and the printing position, the predetermined length of each colored ink region, and an amount with which the ink ribbon has been fed after the detecting means detects the ink color.

18. A method for producing a tape-shaped label through printing on a tape with an ink ribbon formed with a plurality of colored ink regions arranged in a predetermined order, the method comprising the steps of:

detecting, once prior to commencing printing, ink color of a colored ink region on the ink ribbon located at a detecting position, the ink ribbon being formed with a plurality of colored ink regions arranged in a predetermined order, each colored ink region having a predetermined length;

feeding both a tape and the ink ribbon in a printing direction in synchronization with each other with an amount causing a colored ink region of a desired ink color to be positioned at a printing position; and printing the tape with the colored ink region of the desired ink color located at the printing position.

19. A tape-shaped label producing method as claimed in claim 18, wherein the amount, with which the tape and the ink ribbon are fed, is determined based on a distance between the detecting position and the printing position.

20. A tape-shaped label producing method as claimed in claim 18, further comprising the steps of:

feeding both the tape and the ink ribbon in the printing direction after the printing with the desired ink color is completed, the tape and the ink ribbon being fed with another amount causing a colored ink region of another desired ink color to be positioned at the printing position;

reversely feeding the tape in a reverse printing direction with an amount causing a desired point of the tape to be positioned at the printing position; and printing the desired point of the tape with the other desired ink color.

21. A tape-shaped label producing method as claimed in claim 20, wherein the other amount, with which the tape and the ink ribbon are fed, is determined based on an amount with which the ink ribbon has been fed and the predetermined length of each colored ink region, and wherein the amount, with which the tape is reversely fed, is determined based on an amount with which the tape has been fed.

22. A tape-shaped label producing method as claimed in claim 20, wherein the tape is printed with the ink ribbon while the tape and the ink ribbon are pressed between a platen and a print head.

23. A tape-shaped label producing method as claimed in claim 22, wherein the tape and the ink ribbon are fed in the printing direction while the tape and the ink ribbon are pressed between the platen and the print head.

24. A tape-shaped label producing method as claimed in claim 23, wherein the reverse feeding step includes the steps of:

separating the platen and the print head from each other; and reversely feeding the tape in the reverse printing direction.

25. A tape-shaped label producing method as claimed in claim 18, wherein the ink ribbon is formed with two colored ink regions arranged alternately, each colored ink region having a predetermined length, wherein both the tape and the ink ribbon are fed in the printing direction with the amount causing a starting edge of a colored ink region of one color to be positioned at the printing position, and wherein the tape is printed with the desired color while the tape and the ink ribbon are fed in the printing direction with a first amount less than the predetermined length so that the tape is printed from its print start point toward its print end point which is apart from the print start pint with the first amount.

26. A tape-shaped label producing method as claimed in claim 25, further comprising the steps of:

feeding both the tape and the ink ribbon in the printing direction after the printing with the one color is completed, the tape and the ink ribbon being fed with a second amount which is obtained by subtracting the first amount from the predetermined length, thereby causing a starting edge of a colored ink region of the other color to be positioned at the printing position;

reversely feeding the tape in a reverse printing direction with the predetermined length, causing the print start point of the tape to return to the printing position; and printing the tape with the other ink color from the print start point of the tape.

27. A tape-shaped label producing method as claimed in claim 18, further comprising the step of:

mounting a tape cassette to a tape printing device, the tape cassette housing the tape and the ink ribbon, the tape printing device including a detection sensor located at the detecting position for detecting ink color located at the detecting position, a feeding mechanism for feeding both the tape and the ink ribbon in the printing direction, and a printing mechanism for printing the tape with the desired ink color located at the printing position, wherein the detection sensor is controlled to detect ink color of the colored ink region located at the detecting position when the tape cassette is mounted to the tape printing device.

* * * * *